US008413400B2

(12) United States Patent
Mackay Sim

(10) Patent No.: US 8,413,400 B2
(45) Date of Patent: Apr. 9, 2013

(54) RECESS FORMER FOR CONCRETE PANELS

(75) Inventor: Rod Mackay Sim, Epping (AU)

(73) Assignee: Woodstock Percussion Pty Ltd., Epping (AU)

( * ) Notice: Subject to any disclaimer, the term of this patent is extended or adjusted under 35 U.S.C. 154(b) by 0 days.

(21) Appl. No.: 12/304,517

(22) PCT Filed: Jun. 12, 2007

(86) PCT No.: PCT/AU2007/000824

§ 371 (c)(1),
(2), (4) Date: Jan. 29, 2009

(87) PCT Pub. No.: WO2007/143784

PCT Pub. Date: Dec. 21, 2007

(65) Prior Publication Data

US 2009/0320386 A1 Dec. 31, 2009

(30) Foreign Application Priority Data

Jun. 13, 2006 (AU) ..... 2006903184
Oct. 18, 2006 (AU) ..... 2006905791
Feb. 8, 2007 (AU) ..... 2007900593

(51) Int. Cl.
*E04C 3/30* (2006.01)

(52) U.S. Cl. ..... 52/576; 52/125.5; 52/699; 249/96

(58) Field of Classification Search ..... 52/125.5, 52/125.4, 699, 701, 576; 249/91, 94, 96
See application file for complete search history.

(56) References Cited

U.S. PATENT DOCUMENTS

| | | | | |
|---|---|---|---|---|
| 4,000,591 | A * | 1/1977 | Courtois | 52/689 |
| 4,386,486 | A * | 6/1983 | Holt et al. | 52/125.5 |
| 4,437,642 | A * | 3/1984 | Holt | 249/175 |
| 4,580,378 | A | 4/1986 | Kelly et al. | |
| 4,671,554 | A | 6/1987 | Lancelot | |
| 4,807,843 | A | 2/1989 | Courtois et al. | |
| 4,888,922 | A | 12/1989 | Lancelot | |
| 4,930,269 | A * | 6/1990 | Kelly et al. | 52/125.5 |
| 5,535,979 | A * | 7/1996 | Ellis-Callow | 249/94 |
| 6,279,274 | B1 * | 8/2001 | Amiet et al. | 52/125.2 |
| 6,460,824 | B1 * | 10/2002 | Lancelot et al. | 249/91 |

(Continued)

FOREIGN PATENT DOCUMENTS

| | | |
|---|---|---|
| GB | 2202487 | 9/1998 |
| WO | WO 00/60176 | 10/2000 |

*Primary Examiner* — Robert Canfield
*Assistant Examiner* — Babajide Demuren
(74) *Attorney, Agent, or Firm* — K&L Gates LLP

(57) ABSTRACT

A recess former (30) is disclosed for use with anchors (35) which are to be cast into a concrete slab (61). The recess former (30) preferably includes a removable plug (36) and preferably rectangular lugs (57) which engage with corresponding apertures in the attachment head (34) of the lifting anchor and prevent the ingress of cement during casting of the slab (61). In addition, flaps (51) are preferably provided on the recess former to prevent the sides of the attachment head (34) from being encased in the concrete. Preferably the former is pivoted between open and closed positions and has a slightly V-shaped base which when abutted against a mold or formwork, urges the recess former into the closed position. Furthermore, a recess former (60-60I) is disclosed which stays behind after the casting and remains embedded in the concrete in order to provide a waterproof membrane between the recess (62) and adjacent reinforcing rods (58, 59, 71) thereby preventing corrosion of the reinforcing rods.

14 Claims, 24 Drawing Sheets

U.S. PATENT DOCUMENTS

| | | | | |
|---|---|---|---|---|
| 6,550,834 | B2 * | 4/2003 | Fromelius | 294/89 |
| 6,575,424 | B2 * | 6/2003 | Domizio | 249/91 |
| 6,779,312 | B2 * | 8/2004 | Wright | 52/125.5 |
| 2002/0134905 | A1 * | 9/2002 | Domizio | 249/91 |
| 2002/0195537 | A1 * | 12/2002 | Kelly et al. | 249/91 |
| 2003/0019169 | A1 * | 1/2003 | Francies et al. | 52/125.4 |
| 2003/0208968 | A1 * | 11/2003 | Lancelot et al. | 52/125.4 |
| 2004/0010984 | A1 * | 1/2004 | Wright | 52/125.4 |
| 2004/0010985 | A1 * | 1/2004 | Francies et al. | 52/125.4 |
| 2008/0203270 | A1 * | 8/2008 | Connell et al. | 249/94 |

* cited by examiner

RECESS FORMER FOR CONCRETE PANELS

CROSS REFERENCES TO RELATED APPLICATIONS

The present application claims priority to AU 2006-903184 filed in the Australian Patent Office on Jun. 13, 2006, AU 2006-905791 filed in the Australian Patent Office on Oct. 18, 2006, and AU 2007-900953 filed in the Australian Patent Office on Feb. 8, 2007, the entire contents of which are herein incorporated by reference.

FIELD OF THE INVENTION

The present invention relates to a recess former assembly and to a method of forming a recess around a lifting anchor or other embedded item cast into a concrete element.

BACKGROUND ART

During the manufacture of concrete elements, such as panels, beams, columns and other products it is often necessary to cast components of metal or other materials into the concrete element. These components are generally used to attach other elements to the concrete element or are used for the attachment of a lifting shackle for the lifting and handling of the concrete element itself.

Such components include so called lifting anchors which are used to attach lifting equipment to a concrete panel or lice element. One such lifting anchor in widespread use is an elongate substantially planar lifting anchor which is partially embedded into the concrete panel. The anchor has a through aperture adjacent its free end while the other end which is embedded in the concrete is adapted to form a mechanical interlock with the concrete of the panel in which it is embedded. The through aperture is shaped to receive a lifting shackle or other attachment device.

The lifting anchors are embedded in the concrete elements at the time of casting the concrete. When setting up the mould or formwork, the free end of the anchor which has the through aperture to receive the lifting shackle is secured in a recess former. The recess former is attached to the form-work or mould used to cast the concrete element. After the concrete has hardened and the mould or form-work is removed, the recess former is itself removed, leaving a recess in the surface of the concrete element such that the attachment end of the anchor is accessible.

GENESIS OF THE INVENTION

The genesis of the present invention is a desire to provide an improved recess former for forming a recess in a concrete element in which the free end of a lifting anchor or other item embedded in the concrete element is located, thereby allowing the free end of the lifting anchor or other item to be accessible after the concrete has been cast.

SUMMARY OF THE INVENTION

In accordance with a first aspect of the present invention there is disclosed a recess former assembly for cast concrete panels having an anchor with a head and at least one aperture in the anchor head, said assembly comprising a resilient former having an opening which is shaped to receive the head of the anchor and a body which defines the shape of the recess, and a plug shaped to be received in said anchor head aperture to prevent the ingress of cementitous material therein during casting.

In accordance with a second aspect of the present invention there is disclosed a recess former for cast concrete panels having an anchor with a head and at least one aperture in the anchor head, said former having a body which defines the shape of the recess to be formed and an opening in said body which is shaped to receive the head of the anchor, wherein said former includes side walls which are substantially parallel to the axis of said aperture and create a gap between said head adjacent the side walls and said cast concrete.

In accordance with a third aspect of the present invention there is disclosed a recess former for cast concrete panels having an anchor with a head and at least one aperture in the anchor head, said former having a body which defines the shape of the recess to be formed and an opening in said body which is shaped to receive said anchor head, wherein said body opens and closes said opening by a pivotal movement, and said body has a generally planar surface which comes into contact with a generally planar mould wall, said body planar surface being biased to open said opening whereby said body planar surface coming into contact with said mould wall urges said body to close said opening.

In accordance with a fourth aspect of the present invention there is disclosed a recess former for cast concrete panels having an anchor with a head, said former having a stay behind portion the external surface of which is in contact with, and remains embedded in, the cast concrete and the internal surface of which forms the surface of the recess formed around the head of the anchor.

In addition to the forgoing there is also disclosed a concrete element such as a building panel incorporating at least one recess formed by any one of the above mentioned recess formers.

A method of casting and/or lifting a concrete element incorporating at least one recess formed with any one of the abovementioned recess formers as described above is also disclosed.

BRIEF DESCRIPTION OF THE DRAWINGS

Preferred embodiments of the present invention will now be described with reference to the drawings in which.

DETAILED DESCRIPTION

Figure 1:
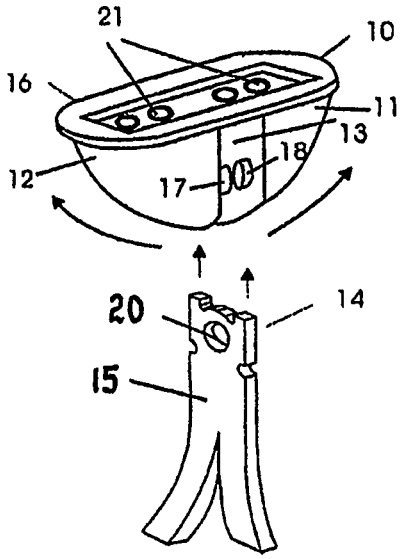
FIG. 1 is an exploded perspective view of a prior art recess former and planar lifting anchor.

Turning now to FIGS. 1 to 4 a prior art recess former 10 which is widely used in Australia is shown in the drawings. The recess former 10 has a truncated semi-spherical shape formed in two halves 11 and 12 hinged in the centre, and separated by a transverse slot 13 which receives the attachment end 14 of a lifting anchor 15. The two halves 11 and 12 are joined by a central section 16 which is flexible and acts as the hinge. A pair of lugs 17 and 18 protrude from the interior walls 19 of the transverse slot 13 towards one another within the slot 13 and engage with a transverse aperture 20 of the lifting anchor 15. The engagement of the pair of lugs 17 and 18 provides a mechanical interlock with the lifting anchor 15 which restricts the anchor 15 from moving or being dislodged from the former 10 during casting of a concrete element (FIG. 4) and positions the anchor 15 in the correct alignment for connection to a lifting shackle (not illustrated) through the transverse aperture 20.

The prior art recess former 10 is fitted with means of bolting it to the surface of the mould or formwork used to cast the concrete, e.g. by passing a bolt or bolts (not illustrated) through the mould wall which extend into the semi-spherical halves 11 and 12 of the body of the recess former 10 via threaded inserts 21. The purpose of the attachment bolts is to firstly position the recess former 10 into the correct orientation for the lifting of the concrete element, and secondly to also mechanically close the recess former 10 about the end of the anchor 15. The two halves 11 and 12 of the recess former 10 are hinged about the centre of the former and when the recess former 10 is pulled back towards the mould wall by the attachment bolts, this causes the two halves of the recess former to close towards the anchor body. Additionally this rotation and closing action of the two halves 11 and 12 of the recess former 10 causes the lugs 17 and 18 located on the inside walls of the slot 13 in the recess former 11 to enter the transverse aperture 20 of the lifting anchor 15. These simple prior art recess formers 10 are economical to produce and provide acceptable performance for many applications.

Figure 3:
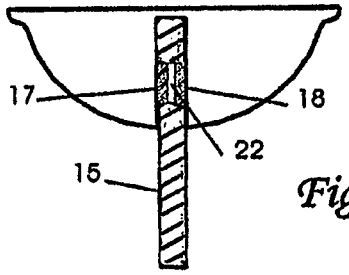
Fig. 3 PRIOR ART
FIG. 3 is a side elevation of the prior art recess former of FIG. 1 with the planar lifting anchor inserted therein.

However, a significant disadvantage of the prior art recess formers 10 is that it is not possible to guarantee that the lugs 17 and 18 completely close together to fill and seal the transverse aperture 20 of the lifting anchor 15, thereby leaving a void 22 (as seen in FIG. 3) inside the transverse aperture 20 of the lifting anchor 15.

Importantly, the dimensions of the retaining lugs 17 and 18 are such that they must provide a clearance between the anchor 15 and the lugs 17 and 18 themselves to enable the recess former 10 to be substantially closed about the anchor 15 without interference.

In practice it has been found that if the lugs 17 and 18 are formed to meet in the centre of the anchor body, this makes the later removal of the recess former 10 difficult, because of mechanical interference between the lugs 17 and 18 and the walls of the transverse aperture 20 in the anchor 15. A further practical difficulty arises during the manufacture of such recess formers 10 in one piece. This is that it is difficult to achieve in one forming operation, both the moulding of the lugs 17 and 18 of a height required to completely fill the space between the inside faces of the slot, without a gap between them, whilst enabling the lugs 17 and 18 to be separable from the mould for the former 10.

Furthermore, gaps between the recess former 10 and anchor 15 are inevitable. All recess formers require a clearance tolerance between the surfaces of the anchor 15 and the recess former 10 to ensure engagement and closure about anchors 15 the dimensions of which will vary according to the generally large dimensional tolerances arising during their manufacture.

The prior art recess former 10 cannot therefore be completely closed around the anchor 15. Consequently, there is a space or void between the surfaces of the anchor 15 and the interior closing surfaces of the recess former 10. These voids permit the entry of cement laden waters which may be sucked into the voids during the casting process by capillary action, and/or surface tension, and/or differential pressure and/or vibrational actions. This is particularly so when vibration is used to settle the concrete and remove the air from the concrete.

In addition to the above, the placement of the anchors 15 and recess formers 10 in the mould with respect to other reinforcing elements often results in forces being applied through the anchors 15 to the recess formers 10 which prevent the complete closure of the recess former 10 about the anchor 15. Such forces commonly result from leverage developed between the anchor 15 and reinforcing steels, and/or movement under self-weight of the anchor 15 and its attached reinforcing elements, and/or the forces applied during the pouring and settling of the concrete. These forces may comprise open the recess former 10 during the casting process thereby creating spaces between the anchor 15 and the recess former 10 which permit the entry of cement laden waters or cement paste.

These problems become more significant when the dimensions and mass of the anchors 15 are increased to an extent where the mass of the anchors 15 themselves may be sufficient to force open the recess former as a result of leverage caused by the anchor 15 cantilevering under its own weight about the wall of the mould to which it is attached by means of the recess former 10.

Another disadvantage of the prior art recess formers 10 is that they require mechanical attachment to the wall of the mould to ensure closure of the two halves 11 and 12 of the recess former 10 about the anchor 15 in order to retain the anchor 15. This attachment is usually provided by means of bolts passing through holes drilled through the mould wall. It is often convenient to use the same mould for manufacture of concrete components of differing dimensions necessitating different anchor positions. A significant disadvantage for the user is that the bolt holes in the moulds must be stopped when the recess formers 10 are moved away from the previously used positions. This is time consuming and may result in a poor quality finish of the concrete component at the position of the stopped holes as a result of imprinting of the holes or their stopping material upon the concrete cast against them.

In such cases it would be desirable to allow the former 10 to be closed around the anchor head but not physically attached to the mould, thereby eliminating the need for attachment holes to be provided in the mould. This is not practically possible with the prior art recess formers 10 because the hinged halves of the recess formers are free to open even under minor loads and/or vibrations unless restrained by a pulling force applied between the mould and the body of the recess former.

After the concrete has hardened the mould and recess former 10 are removed thereby exposing the attachment end of the anchor 15 inside the recess formed by the removal of the recess former 10.

When using the prior art recess former 10 as described above, cement which has flowed into spaces between the recess former 10 and the anchor 15 makes the connection of the lifting shackle or other attachment device difficult or impossible. Where cement has hardened inside the transverse aperture 20 it prevents the connection of the attachment device. This cement is extremely difficult to remove because the aperture is normally located below the surface of the concrete. The removal of the hardened cement is impeded by the confining space of the walls of the recess.

What is desirable is a method of casting a recess around the anchor, of retaining the anchor tightly in its correct position in such a way that the integrity of the recess is not compromised during the casting process and which guarantees that after removal of the recess former that the attachment aperture will be clean and free of cement or other fouling materials. Additionally a recess former which may be closed around the head of the anchor and which does not require an outside closing force to enable it to remain properly intact would be of great benefit to modem production facilities where it is not desirable to damage the walls of the mould by drilling or other attachment means.

Another problem associated with prior art lifting anchors is that the side edges of the attachment end of the anchors are embedded in the concrete surface of the recess. When a lifting load is applied to the anchor, the compression load is transferred to the concrete at the points where the anchor is attached thereto. Therefore, the load is substantially applied at the thin section of concrete between the sides of the recess and the upper panel surface perpendicular to the anchor adjacent to the anchor. If the load is large enough the concrete will fail at these locations. It has been found that in most circumstances there is concrete failure as the steel reinforcing embedded in the concrete is not able to share the compression load. When the concrete fails, time consuming patching is required to fill cracks and the result can be unsightly. It is believed that it would be advantageous if the attachment end of the lifting anchor was not in contact with the concrete of the formed recess.

Turning now to the first embodiment of the present invention illustrated in FIGS. 5 to 12, a recess former 30 having a truncated semi-spherical shape is formed in two halves 31 and 32 with a slot 33 adapted to receive the attachment end 34 of a lifting anchor 35. The two halves 31 and 32 have a central section 42 which is flexible and acts as the hinge. The recess former 30 includes a plug 36 which is preferably removable and which fits into a transverse aperture 37 of the lifting anchor 35. The plug 36 extends between oppositely facing surfaces 38 and 39 of the lifting anchor 35 such that it enables a means of mechanical connection with the surrounding body of the recess former 30. The ends of the plug 36 are shaped to engage with a frictional fit in corresponding receiving recesses 40 and 41 in the interior surfaces of the slot 33.

The recess former 30 is preferably moulded in one piece with the two halves 31 and 32 joined by the hinge section 42. This enables the two halves 31 and 32 to be closed over the attachment end 34 of the lifting anchor 35 thereby preventing the ingress of cement during the casting of the concrete. The plug 36 is preferably made from metal or plastics material and can be rigid or flexible. It fits into the aperture 37 such that cement cannot fill the aperture to an extent sufficient to impede a shackle or connection device from being received with the aperture 37. The recess former 30 can be solid or can have a hollow interior.

The recess former 30 is removed from the hardened concrete by rotating each half 31 and 32 of the recess former 30 about the central hinge section 42, thereby releasing the recess former 30 from the plug 36 and anchor 35. After the removal of the plug 36 from the attachment end 34 of the anchor 35, the transverse aperture 37 in the exposed anchor 35 is exposed with a clean surface through which the attachment device or lifting shackle may be easily passed. This recess former 30 eliminates the problems associated with the fouling of the attachment aperture with concrete, even under aggressive casting conditions and heavy vibration in the mould.

In a modification the body of the recess former 30 is made in two halves e.g. of rigid plastics material which are clipped or otherwise held together about an axis parallel to the axis of the anchor 35. A means of retaining the transverse plug 36 is provided within each of these halves. The halves themselves are held tightly together to prevent the ingress of cement to their interior cavities by means of a surrounding ring or by means of clips and pins moulded into the plastic body of each half and/or the transverse plug 36.

In other modifications the transverse plug 36 and recess former 30 are held together by means of magnetic attraction between a ferromagnetic plug 36 and magnetic implants embedded within the halves 31, 32.

Figure 12:
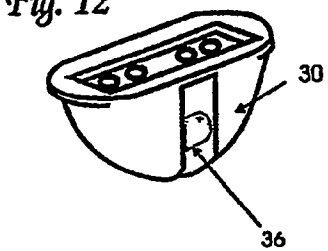
FIG. 12 is a perspective view of the recess former of FIG. 6, FIGS. 12A-12C are each perspective views of opposite halves of modified formers.
Figure 12D:
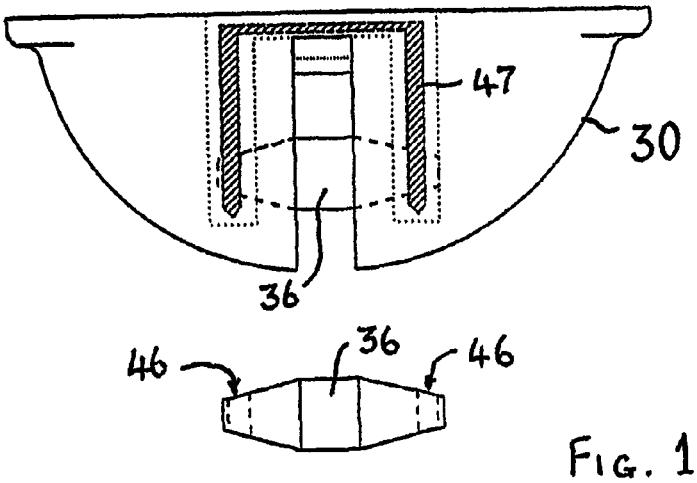
FIG. 12D is an exploded and assembled sided elevation of a modified recess former including a locking rod.
Figures 12A, 12B, 12C:
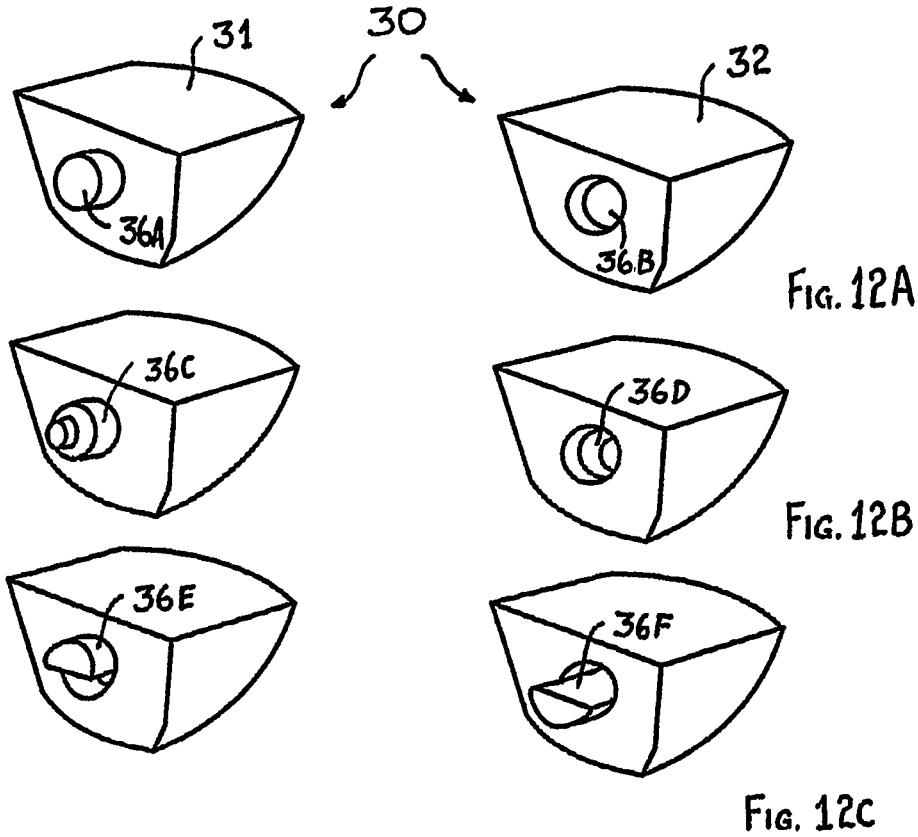
FIG. 12E is both an exploded perspective view, and an assembled perspective view, of an anchor including an attachment plate.

A still further modification is illustrated in FIGS. 12A-12C. In FIG. 12A the recess former 30 is fabricated with a cylindrical plug 36A integrally formed with one half 31 whilst the other half 32 has a correspondingly shaped recess 36B which receives the plug 36A when the two halves 31, 32 of the recess former 30 are brought together. In FIG. 12B, a stepped cylindrical plug 36C and a stepped cylindrical recess 36D are provided instead, whilst in FIG. 12C each of the halves 31, 32 are provided with a complimentary longitudinally split half-cylindrical plug and recess combination 36E and 36F respectively.

In another modification illustrated in FIG. 12D, the ends of the transverse plug 36 each contain a hole 46 or other such recess capable of being interconnected with a rod 47 or other member introduced perpendicular to the central axis of the transverse plug 36 through apertures provided in the recess former body from the surface of the recess former adjacent to, or attached to, the mould wall. This modification incorporates the substantially "U" shaped locking rod 47 (or other such means of securing the transverse plug 36 within the body of the recess former 30) to prevent the recess former 30 from opening during the casting of the concrete. This modification does not require a closing force applied to the recess former body by the mould wall to ensure that the recess former 30 is sealed against the ingress of cement waters between the anchor 35 and the body of the recess former 30. Advantageously, this modification to the recess former need not be directly attached to the wall of the mould, eliminating the requirement to provide attachment holes or other such apertures in the concrete mould or form-work.

A further modification to the transverse plug 36 enables it to be used advantageously with the prior art recess former 10 of FIGS. 1-4. This modified plug is a short cylinder which is fitted into the transverse aperture 20 of the anchor 15 and fills the space 22 between the protruding lugs 17, 18 of the prior art recess former 10. Thus the short cylindrical plug is within the transverse aperture of the anchor body and preferably fills the space of void 22 of FIG. 3. Importantly this enables the prior art recess formers 10 to be utilized with anchors 15 having a transverse hole 20 shaped differently to the form or dimensions of the retaining lugs 17, 18 formed in the prior art recess former 10, merely by using an appropriately shaped plug to ensure that any void between the anchor 15 and the lugs 17, 18 is entirely filled.

Other modifications to the transverse plug 36 include not only plugs which are substantially solid but plugs which have hollow sections and are either of unitary construction or of separable pieces. The latter assist in the disassembly and removal of the transverse plug 36 from the recess former body 30 and the anchor 35. Such separable sections of the transverse plug 36 can include halves which mate about a central horizontal axis or an inclined plane.

Figure 12E:
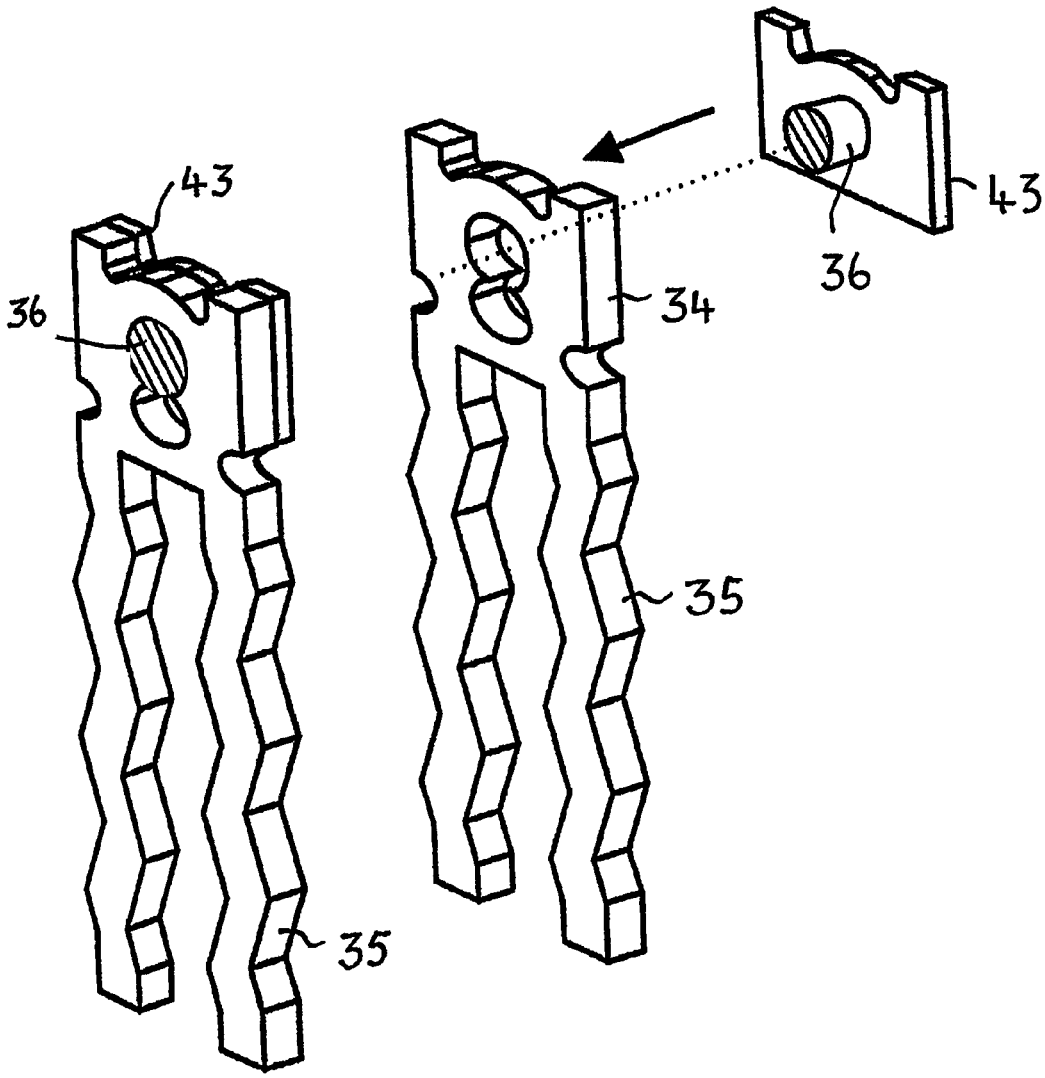
Figure 13:
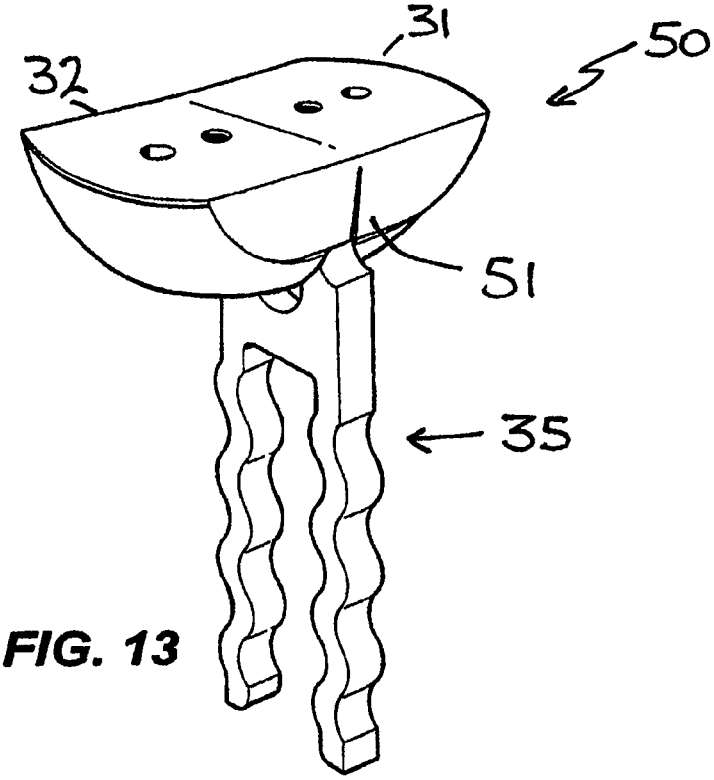
FIG. 13 is a perspective view of a recess former of another embodiment shown being attached to another embodiment of the anchor.
Figure 14:
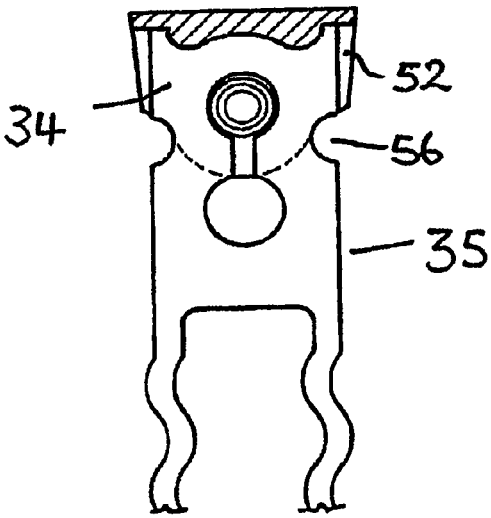
FIG. 14 is a cutaway transverse section of the recess former and anchor of FIG. 13.
Figure 15:
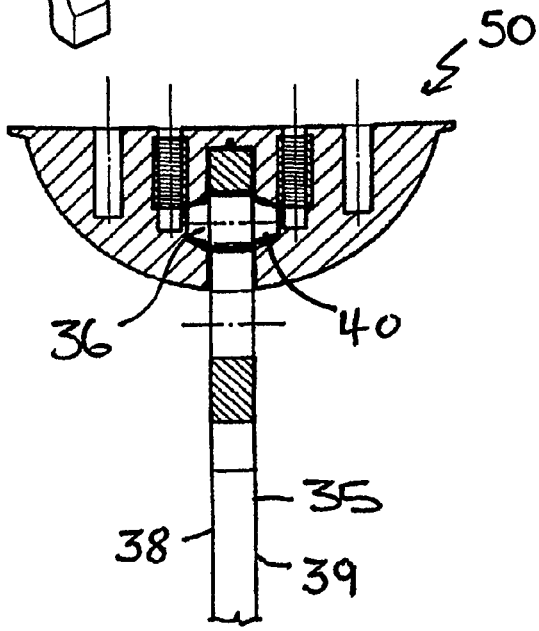
FIG. 15 is a longitudinal section of the recess former and anchor of FIG. 13.
Figure 16:
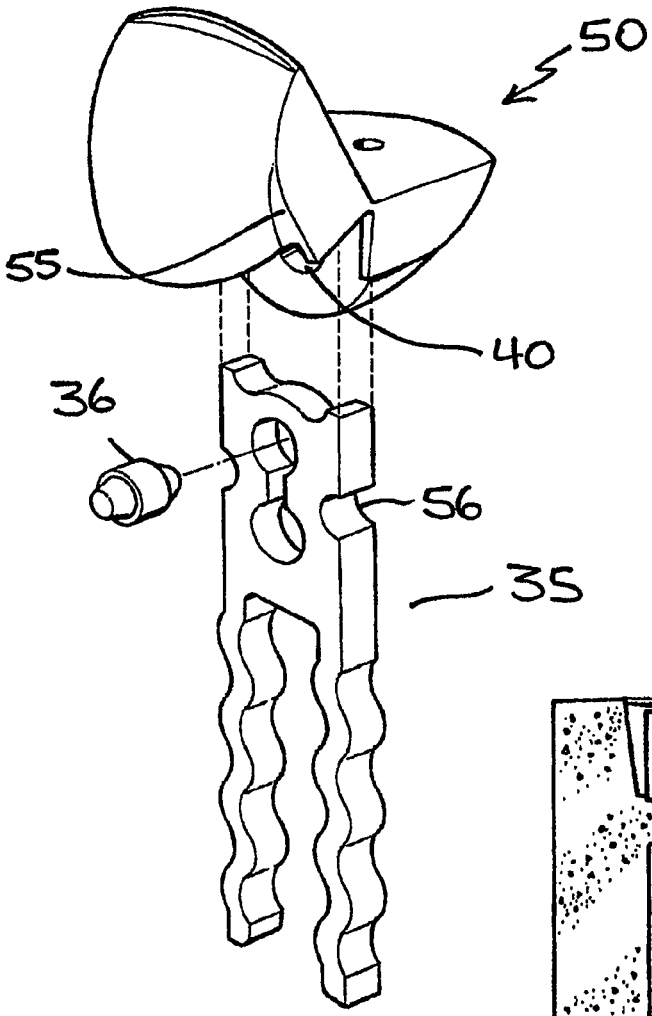
FIG. 16 is an exploded perspective view of the recess former and anchor of FIG. 13 showing how the anchor is attached to the recess former.
Figure 17:
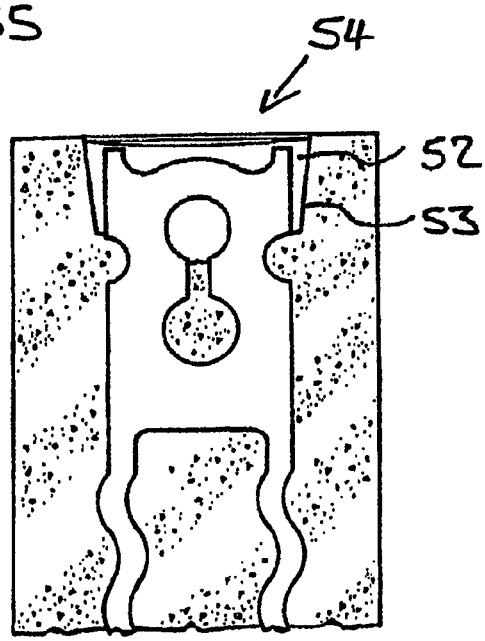
FIG. 17 is a cutaway transverse section showing the anchor of FIG. 13 embedded in a slab of concrete with its head located within a recess formed by the recess former of FIG. 16.

Another modification illustrated in FIG. 12E, the transverse plug 36 is cylindrical and includes an attached plate 43 of similar form to the exposed end of the anchor body 35. This plate 43 is positioned and retained by the transverse plug 36 to enable an anchor attachment end 34 to be retained securely within a recess former 30 which has a receiving slot 33 of width wider than the thickness of the anchor attachment end 34 about which it closes. This modification enables the common use of one standard recess former body 30 for anchors 35 of similar design for attachment to a common shackle but where the anchor thicknesses vary according to the design load requirements. In a still further modification such a plate is releasably attached to the plug 36.

Turning now to the embodiment illustrated in FIGS. 13 to 17, the recess former 50 is substantially similar to the recess former 30 illustrated in FIGS. 5 to 12 except that the recess former 50 has side flaps 51. These flaps 51 extend along the longitudinal sides of the two halves 31 and 32 such that the attachment end 34 of the anchor 35 is enclosed by the recess former 50. This arrangement means that a gap 52 is formed between the attachment end 34 of the anchor 35 and the adjacent surface 53 of the recess 54 formed in the concrete slab. Thus when the recess former 50 is removed from the freshly cast slab, the attachment end 34 is free from the surface of the concrete and therefore does not transfer the lifting load to the concrete at this location. Thus the attachment end 34 is free to deflect without cracking the concrete within the vicinity of the recess 54.

Also seen in FIGS. 13 to 17, the recess former 50 provides a guide 55 (FIG. 16) for the positioning of the steel reinforcing bars which can be placed in the grooves 56 on the side of the attachment end 34 of the anchor 35.

Figure 20:
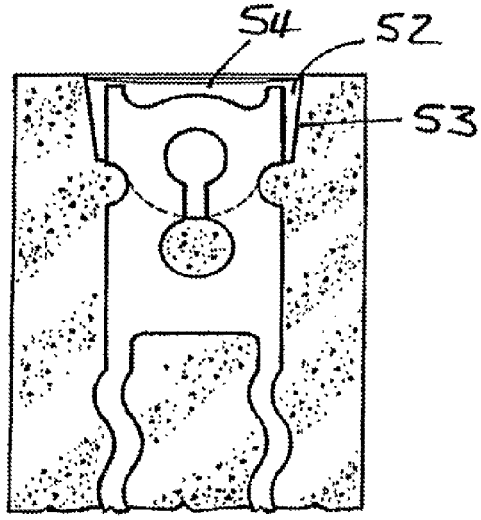
FIG. 20 is a cutaway transverse section showing the anchor of FIG. 13 embedded in a slab of concrete with its head located in a recess formed in the slab by the recess former of FIG. 18
Figure 21:
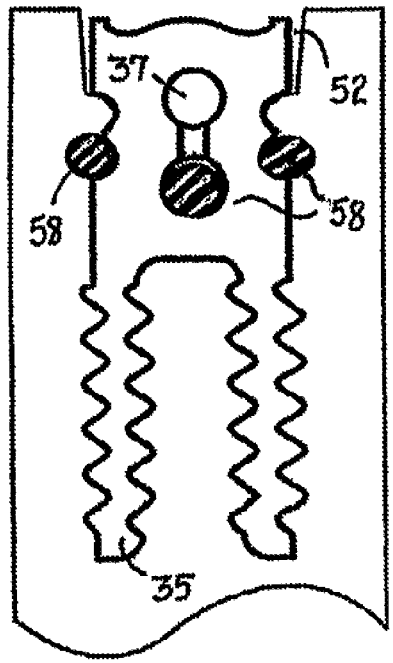
FIG. 21 is a view similar to FIG. 20 but showing one form of reinforcement.
Figure 22:
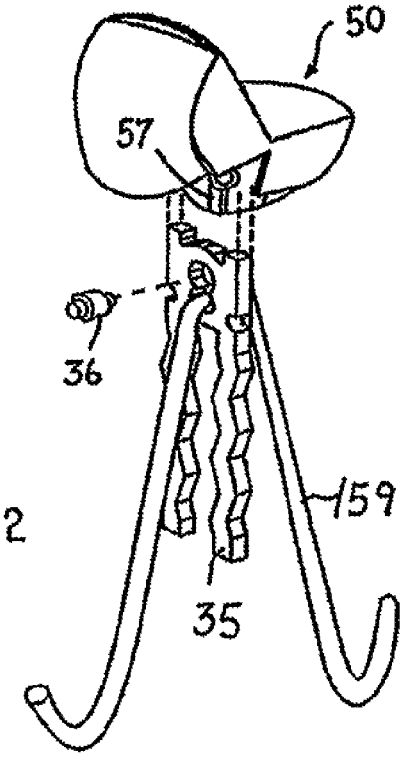
FIG. 22 is an exploded perspective view of the former, anchor and reinforcement.

In a modification of this embodiment which is illustrated in FIGS. 18 to 22, the recess former 50 has in addition of a pair of rectangular lugs 57 located on the surfaces forming the slot 30. The lugs 57 are adapted to fit into a slot portion 158 of the aperture 59 of the anchor 35. The lugs 57 provide an interlocking action between the anchor 35, the transverse plug 36, and the recess former 30 which precludes the dislodgement of the anchor 35 from the recess former 30 whilst the recess former 30 is closed about the anchor head 34. These lugs 57 prevent a bridge of concrete forming in this slot portion when casting the concrete. Such a bridge if formed can mechanically interfere with the lifting device being secured to the anchor thereby making connection difficult. FIG. 20 illustrates the anchor without reinforcement, FIG. 21 illustrates the anchor with three substantially parallel reinforcing bars 58 and FIG. 21 illustrates the anchor with a single substantially U-shaped reinforcing bar 159.

In a variation to the arrangement described in FIGS. 18 to 22, a plastics sleeve or other such spacing element can be placed over the attachment end 34 of the anchor to assist in providing the gap 52 between the attachment end 34 of the anchor 35 and the concrete surface of the recess 54 when the concrete is cast. The plastics sleeve is preferably removed prior to lifting.

Figure 23:
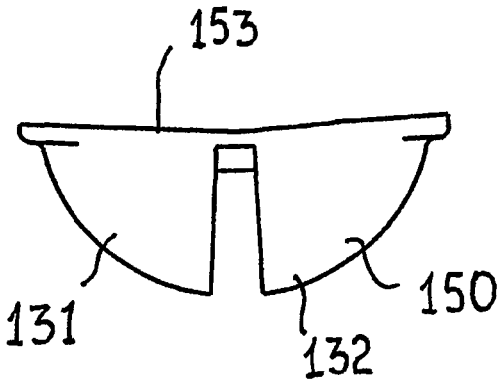
FIG. 23 is a side elevation of a former having built in the bias.
Figure 24:
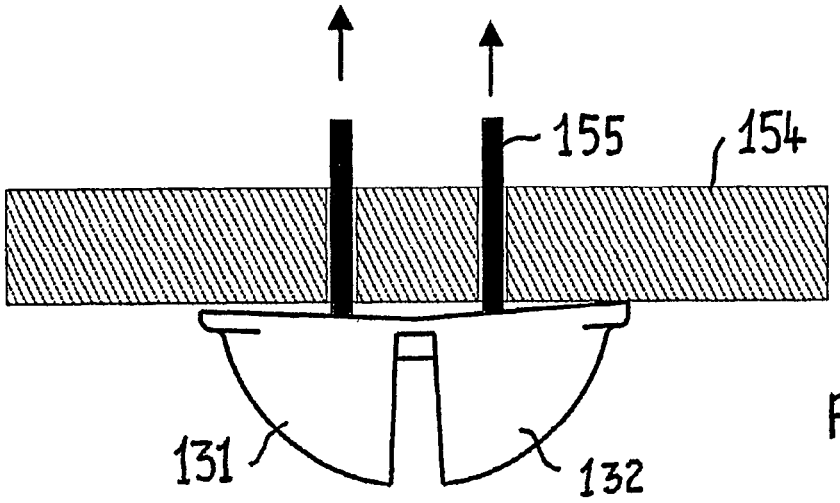
FIG. 24 is a similar side elevation showing the former of FIG. 23 being placed against a mould or formwork.
Figure 25:
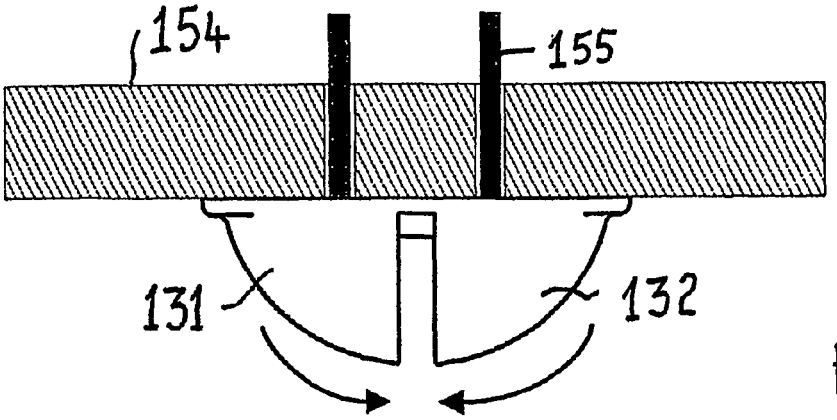
FIG. 25 is a view similar to FIG. 24 but showing the former tightened against the mould.

In another variation illustrated in FIGS. 23-25, a recess former 150 can be moulded with a substantially V-shaped bias moulded into the traditionally previously flat face 153 of the recess former 150 which abuts the formwork or mould 154. When the recess former 150 is applied to the formwork by means of bolts 155 schematically illustrated in the drawings, the forces applied by the formwork 154 and bolts 155 to "straighten out" the base 153 of the recess former 150 are such that the recess former halves 131 and 132 clamp onto the anchor attachment end 34 with a tight fit. This prevents the ingress of cement during casting. Anchors of different thicknesses are also suitable to be used with such a former 150 because differences in thickness of the anchor are able to be accommodated by different degrees of compression of the former halves 131 and 132.

Figure 26:
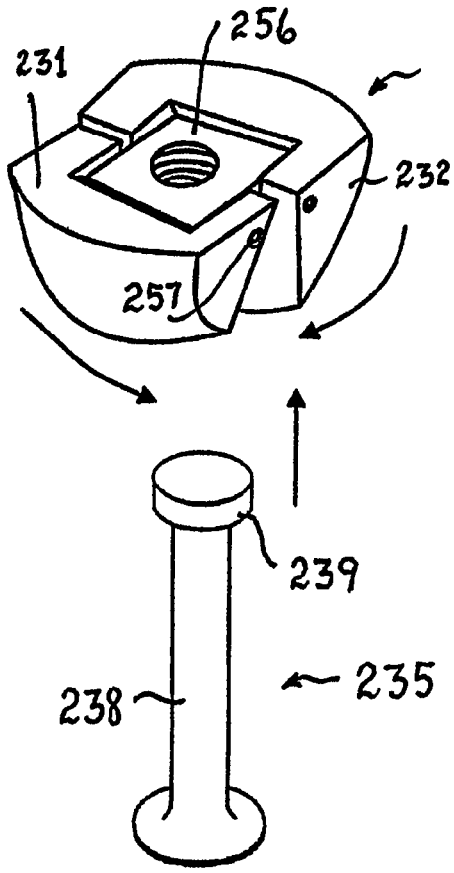
FIGS. 26 and 27 are respectively exploded and assembled perspective views of a still further recess former intended for use with a substantially conventional cylindrical anchor.
Figure 27:
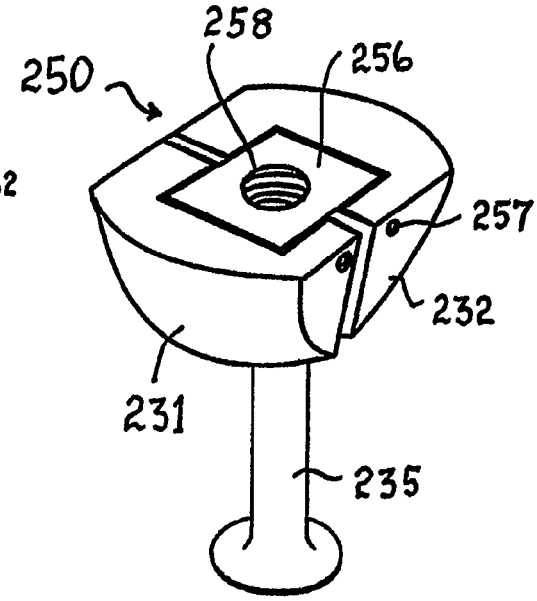

It is not necessary for the recess former to be fabricated in a single piece. As illustrated in FIGS. 26 and 27, a multipart recess former 250 has two separately manufactured halves 231 and 232 which are pivoted about a central block 256 of either solid or resilient material. Here the pivoting is provided by means of pins 257, rather than the flexing of resilient material. The lifting anchor 235 of FIGS. 26 and 27 is of conventional cylindrical form having a stem 238 and a head 239. The block 256 has an aperture 258 shaped to releasably engage the head 239. The former 250, like the former 150, when drawn against the mould or formwork clamps the halves 231 and 232 against the head 239 thereby preventing the ingress of any cementitous as material.

Figure 18:
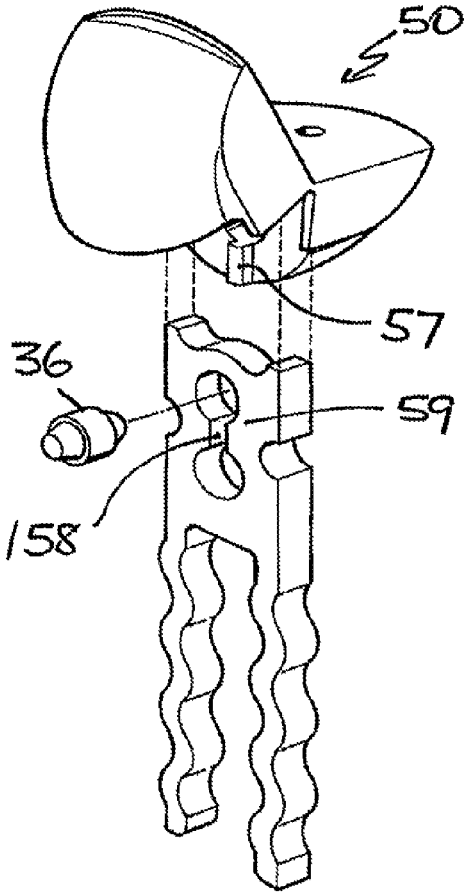
FIG. 18 is an exploded perspective view of a recess former of another embodiment showing how the anchor of FIG. 13 is attached to the recess former.
Figure 19:
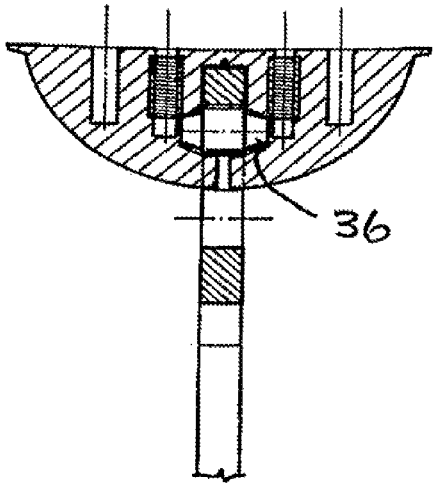
FIG. 19 is a longitudinal section of the recess former and anchor of FIG. 18.
Figure 28:
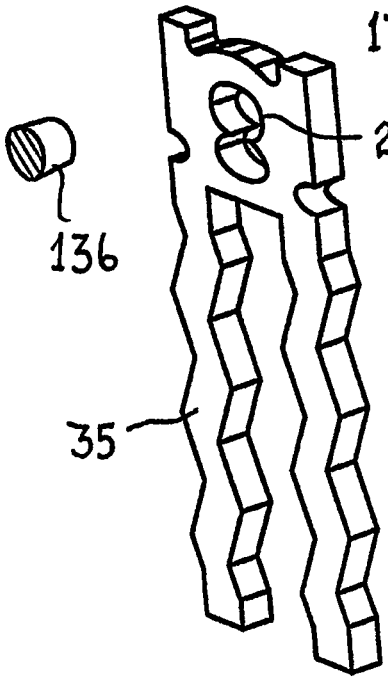
FIGS. 28 and 29 are respectively exploded and assembled perspective views of a cylindrical bar able to be used with the anchor 35.
Figure 29:
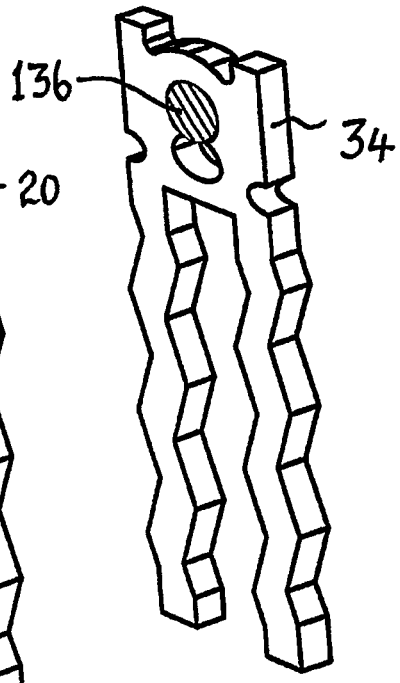

In a further variation illustrated in FIGS. 28 and 29, the cross bar 36 of the recess former 50 can be replaced by a bar 136 which does not have the frusto-comical ends illustrated, but only the central cylindrical portion. Such as a bar 136 fits into the transverse aperture 20 of the lifting anchor 35, but does not extend beyond the side wall of the anchor. The bar 136 fits into the aperture 20 to prevent ingress of cement during the pouring of the concrete slab. This arrangement is most effective when the lugs 57 of the embodiment of FIG. 18 are used in the recess former 50. However, it has been found that other forms of interlocking the anchor into the recess former are also effective. Such forms can include interlocking side lugs which mate with the grooves 56 (FIG. 14) of the anchor and magnetic retention means to prevent movement of the anchor. It is noted that when the above described cylindrical bar 136 is used instead of the crossbar 36, the receiving recesses 40 (FIG. 16) can be removed from the recess former 50. It is also noted that the cylindrical bar 136 can be used with a recess former which includes a receiving recess 40 as there is substantially no ingress of concrete if recesses 40 are present.

Figure 2:
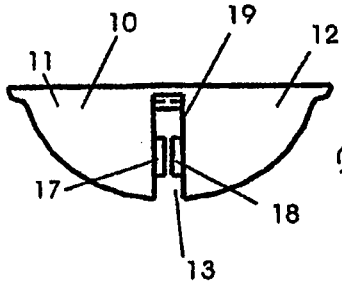
FIG. 2 is a side elevation of the prior art recess former of FIG. 1.
Figure 4:
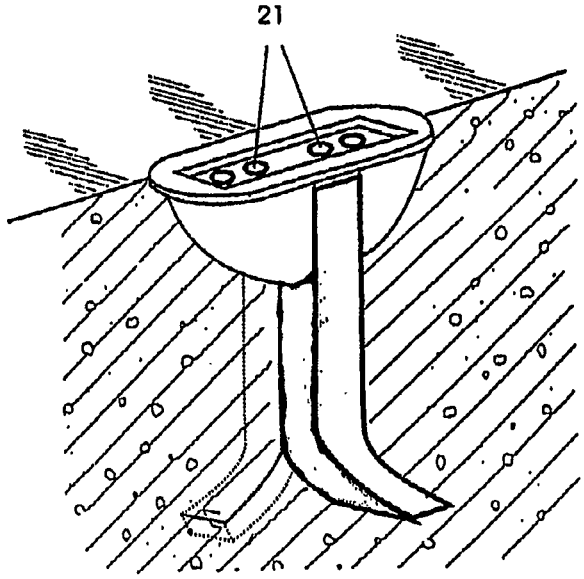
FIG. 4 is a cutaway perspective view of the prior art recess former and planar lifting anchor of FIG. 1 shown in concrete after it has been cast and before the removal of the recess former.
Figure 8:
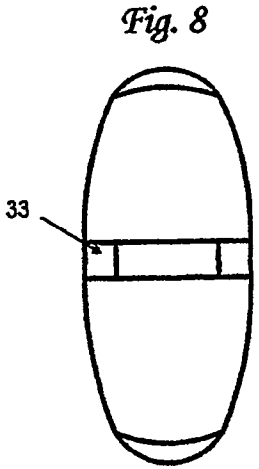
FIG. 8 is an inverted plan view of the recess former of FIG. 6.
Figure 7:
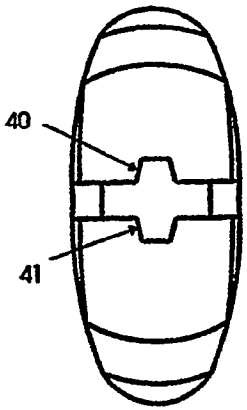
FIG. 7 is a cross sectional view of the recess former of FIG. 5 along line VI-VI of FIG. 6.
Figure 6:
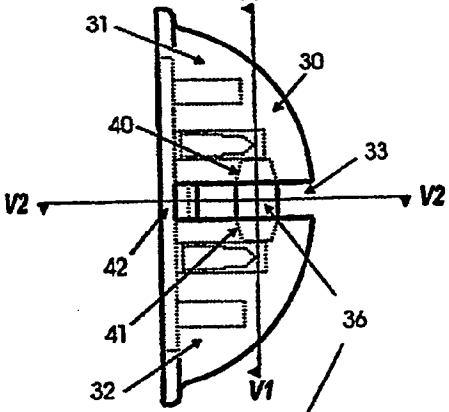
FIG. 6 is a side elevational view of the recess former of FIG. 5.
Figure 9:
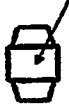
FIG. 9 is a side elevation of the plug for the recess former of FIG. 6.
Figure 10:
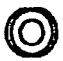
FIG. 10 is an end view of the plug of FIG. 9.
Figure 5:
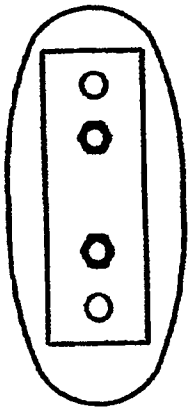
FIG. 5 is a plan view of a recess former of a preferred embodiment.
Figure 11:
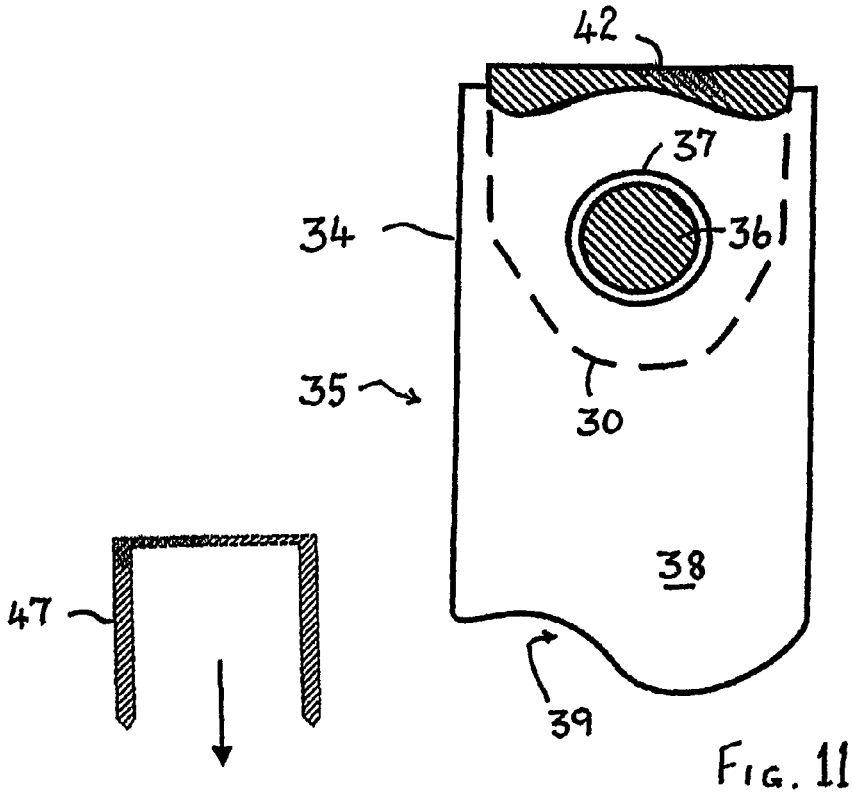
FIG. 11 is a transverse cross sectional view of the recess former of FIG. 6 along line V2-V2 showing the lifting anchor secured thereto.

In a still further variation, the recess former 30, 50 described above can also include lugs 17 and 18 as seen in the prior art recess former 10 of FIGS. 1 to 4 whereby the cylindrical bar 136 as described above fills the gap 22 (FIG. 3) in the aperture of the anchor left between the two lugs 17 and 18. In this variation, the bar 136 does not extend beyond the sides of the anchor and the anchor is maintained within the recess former as described above.

Figure 30:
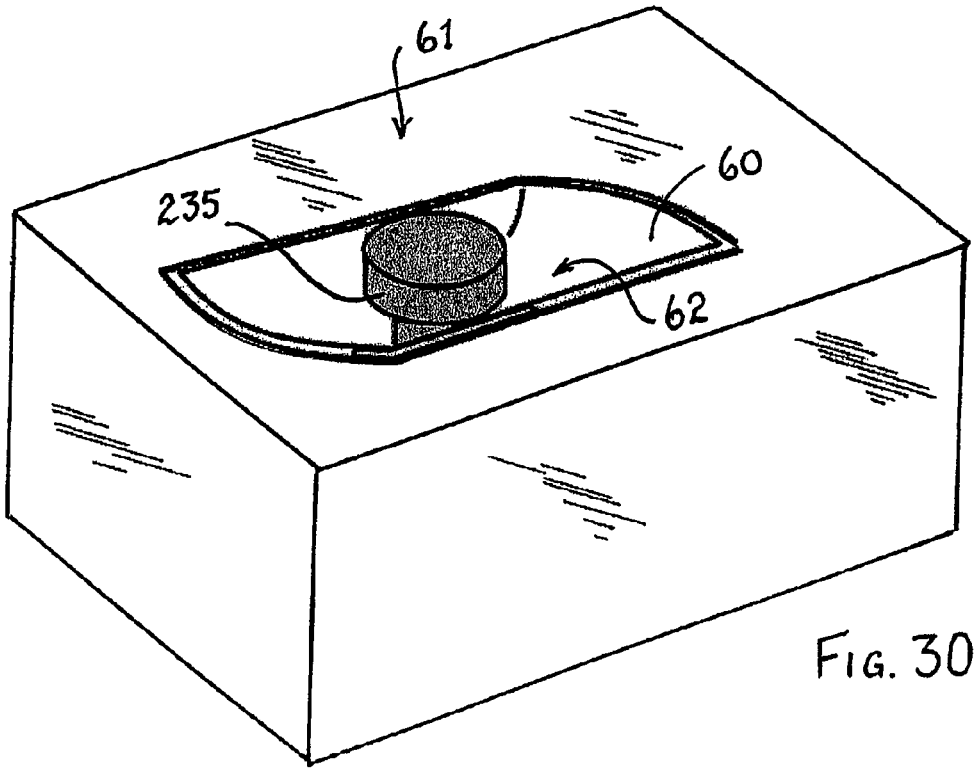
FIG. 30 is a perspective view of an embedded or stay behind recess former of another embodiment suitable for generally cylindrical anchors.
Figure 31:
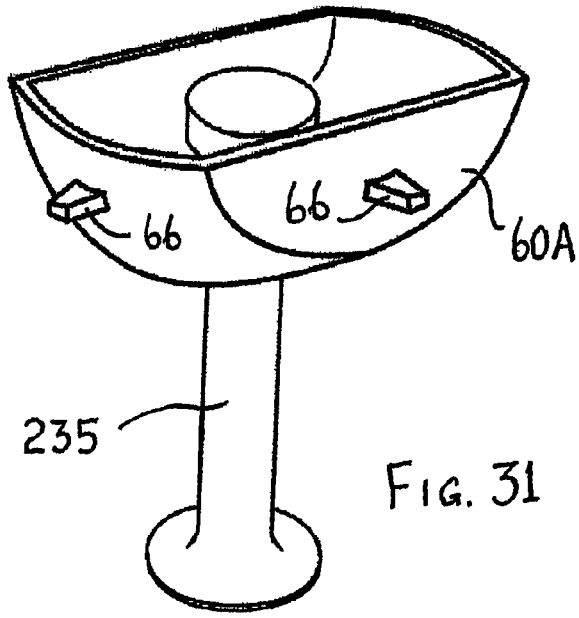
FIG. 31 is a perspective view of the former of FIG. 30 prior to its end casement in concrete.
Figure 32:
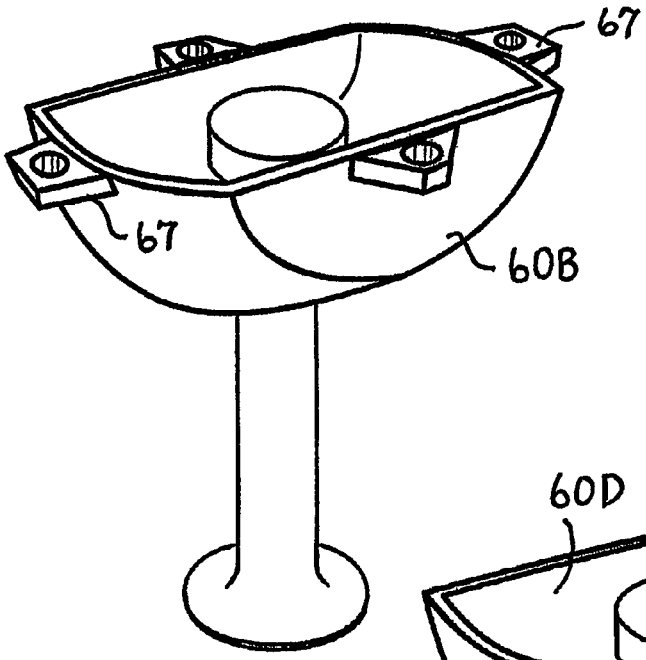
FIG. 32 is a perspective view of another embodiment similar to that of FIGS. 30 and 31.
Figure 33:
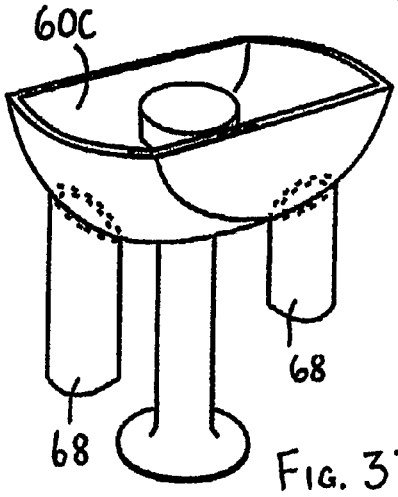
FIG. 33 is a perspective view of a still further embodiment.

In a still further variation, the bar fitting between the lugs 17 and 18 as described above also includes a flange like protuberance to fit into the key like channel of the aperture of the anchor 35. The flange like protuberance substantially fills the channel to prevent ingress of cement during the concrete pour. Turning now to FIG. 30, an installed lifting anchor 235 of the conventional substantially cylindrical type is shown installed in a concrete slab 61. Surrounding the anchor 235 and defining the recess 62 is an embedded, or stay behind, former 60. The former 60 has the traditional truncated semi-spherical configuration but is formed from a thin wall of plastics material. Most importantly, the former 60 is preferably water impervious and so provides a layer of waterproof material between the embedded reinforcing of the concrete of and the exterior of the concrete slab 61. This is to be contrasted with the situation in FIG. 1 where a reinforcing rod retained within the semicircular bight located on each edge of the anchor 15 is only a few millimeters from the surface of the recess formed by the recess former 10 after its removal. In order to prevent "concrete cancer" or the corrosion of the reinforcement within the concrete slab 61, traditional building code standards require a thickness of concrete of approximately 20-30 mm to cover any of the reinforcing rods. Clearly this is not achieved with the prior art arrangement of FIG. 1 and for this reason the anchor 15 itself is normally galvanized. However, the reinforcing rods are not galvanized and have not hitherto been protected by a sufficiently thick layer of concrete. In order to fully comply therefore with standards relating to "concrete cancer", it has been necessary to fill the recess surrounding the head 14 of the anchor 15 in order to fully protect the adjacent reinforcing rod(s). Often this requirement is overlooked during construction or deliberately not done. However, in the arrangement illustrated in FIG. 30 any adjacent reinforcing rod is protected from corrosion by means of the former 60. One way of achieving such a former is illustrated in FIG. 31 where the former 60A is provided with cantilevered anchoring protrusions 66 which anchor the former 60A in the slab 61. An alternative arrangement is illustrated in FIG. 32 where the former 60B is provided with apertured lugs 67 which enable it to be secure to a mould or formwork such as that illustrated in FIGS. 24 and 25. In a still further arrangement illustrated in FIG. 33 the former 60C is provided with two internally threaded sleeves 68 which are able to receive the threaded shanks of bolts which pass through the mould or formwork and so secure the former 60C relative to the mould prior to casting.

Figure 34:
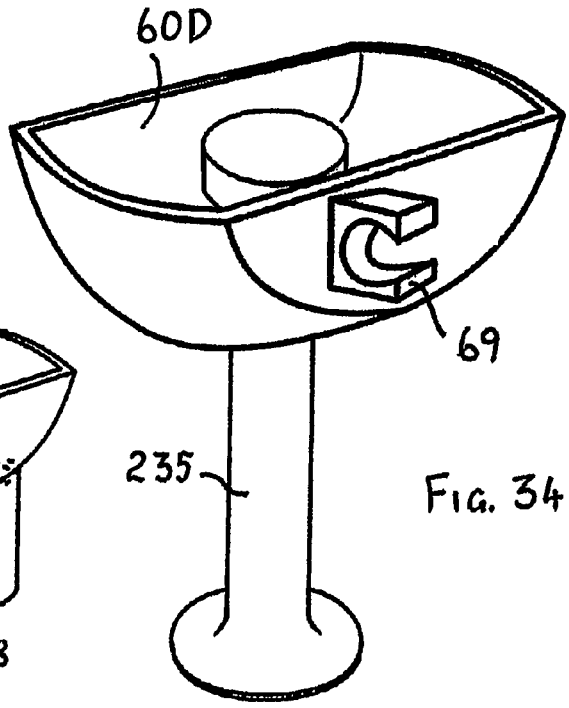
FIG. 34 is a perspective view of another embodiment incorporating a reinforcement locating mechanism.
Figure 35:
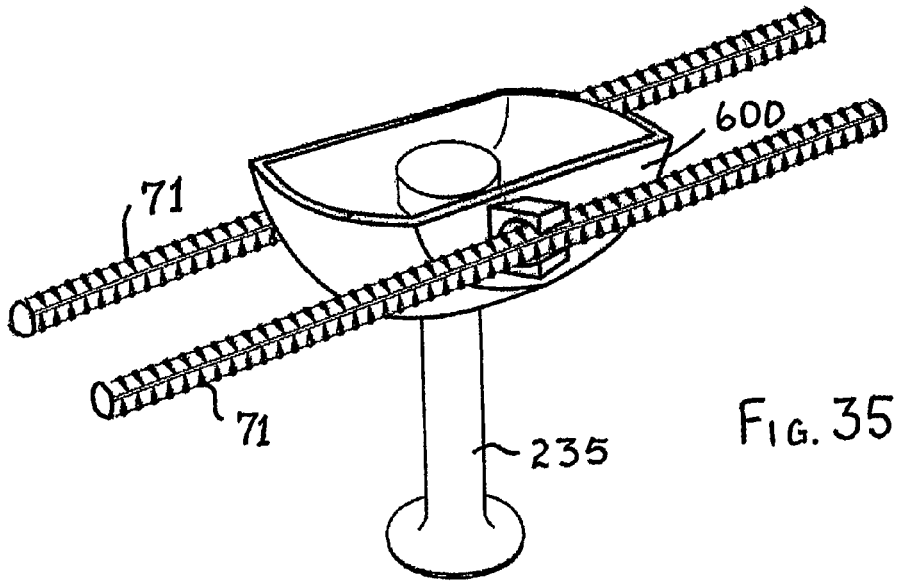
FIG. 35 is a perspective view of the former of FIG. 34 with the reinforcement in place.
Figure 36:
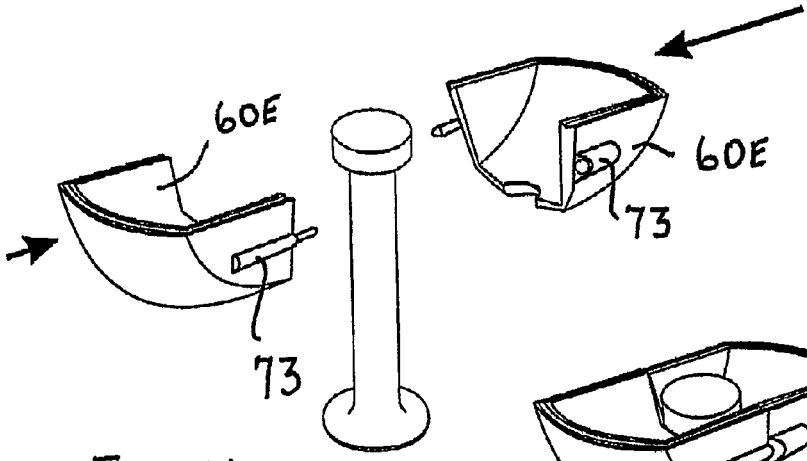
FIG. 36 is an exploded perspective view of a two-part former with snap engagement means.
Figure 37:
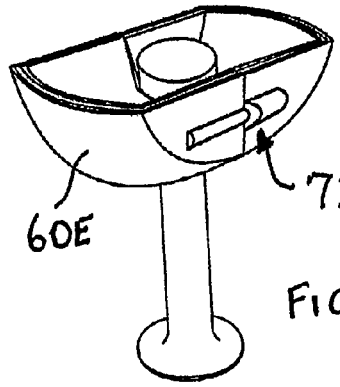
FIG. 37 is a perspective view of the former of FIG. 36 assembled.

Turning now to FIGS. 34 and 35, preferably the former 60D is provided with U-shaped reinforcing supports 69 which, as seen in FIG. 35 enable the reinforcing rods 71 to hold the former 60D in position prior to casting. After casting the former 60D protects the reinforcing rods 71 in the vicinity of the anchor 235 from corrosion. As seen in FIGS. 36 and 37, the former 60E can be fabricated in two pieces and provided with snap-engaging locking attachments 73 to enable the two pieces to be secured together.

Figure 38:
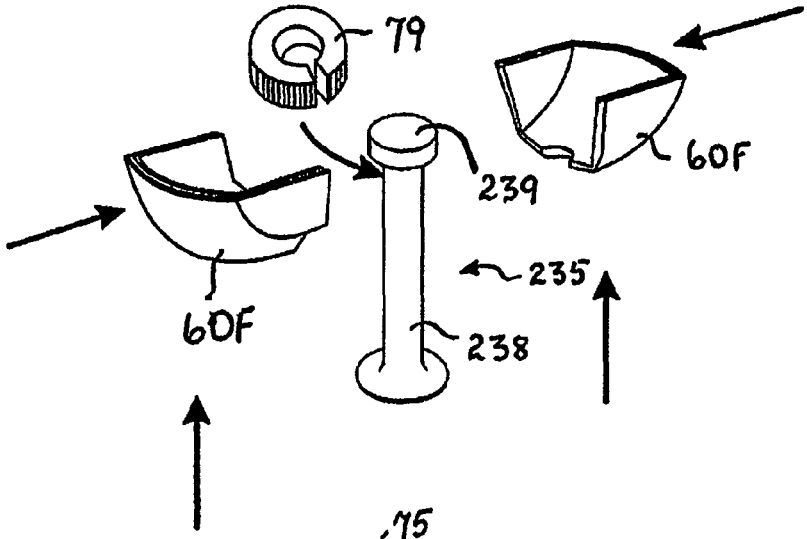
FIG. 38 is an exploded perspective view of another embodiment of a two-part former suitable for use with substantially cylindrical anchors.
Figure 39:
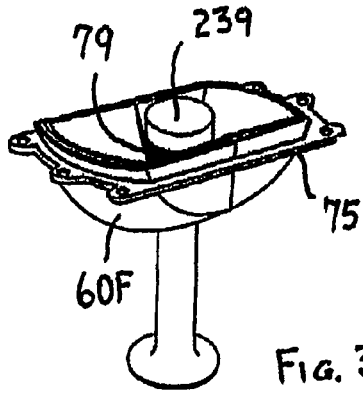
FIG. 39 is a view of the former of FIG. 38 assembled.

An alternative securing arrangement is illustrated in FIGS. 38 and 39 where a two-part former 60F is provided with a rectangular surround 75 the interior of which exactly matches the external perimeter of the former 60F when assembled. A split grommet 79 placed around the stem 238 of the anchor 235 and below the head 239 of the anchor, prevents ingress into the recess to be formed of any cementitous liquid during the casting procedure. In this way, the head 239 of the anchor 235 is not fouled. Naturally, both the former 60F and the surround 75 remain embedded in the concrete after it has been cast.

Figure 40:
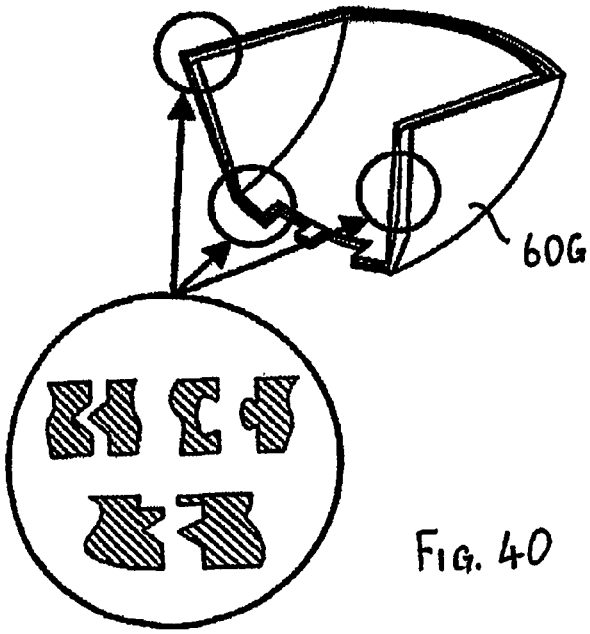
FIG. 40 is a perspective view of one part of a former of the general type illustrated in FIGS. 30-39 and illustrating various sealing profiles applicable to the joining edges of the former.

Turning now to FIG. 40, it is desirable that the various formers 60A-60G when fabricated in two pieces provide a liquid tight seal and this is preferably accomplished via providing a making profile on the joining edges of the former. FIG. 40 illustrates in the enlargement of the edge profile, three possible mating edge profiles.

Figure 41:
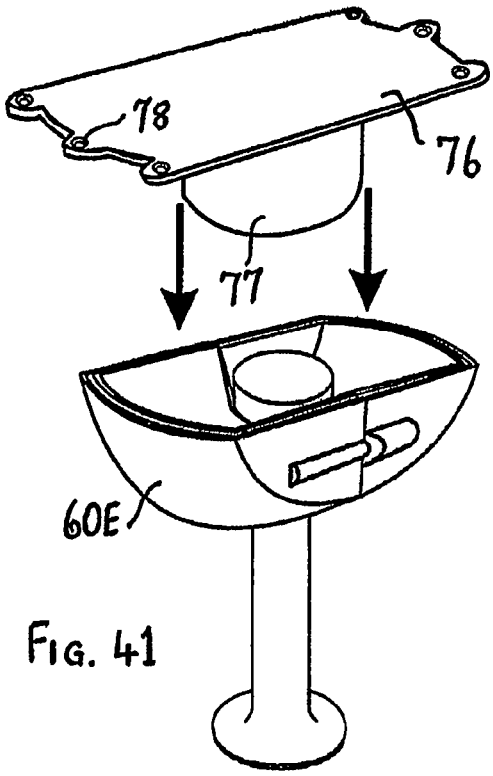
FIG. 41 is an exploded perspective view of yet another two-part former incorporating a sealing plate.
Figure 42:
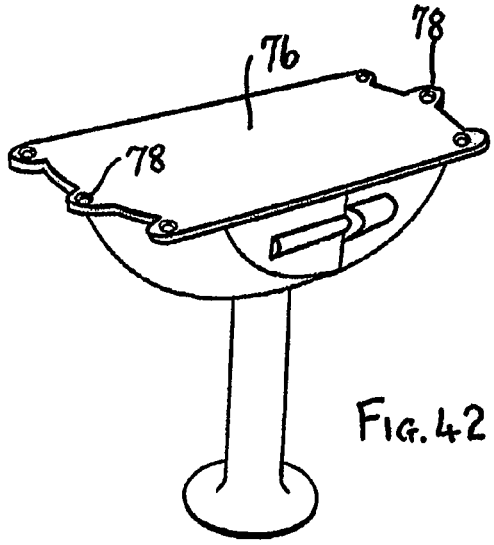
FIG. 42 is a perspective view of the former of FIG. 41 in its assembled state.
Figure 43:
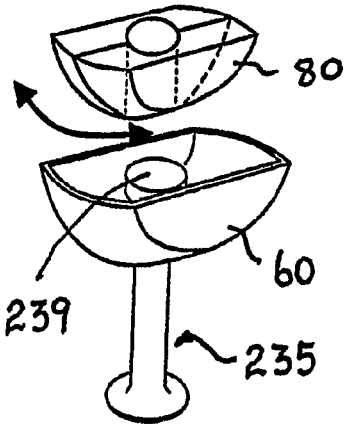
FIG. 43 is an exploded perspective view of a former incorporating a removable interior member.
Figure 44:
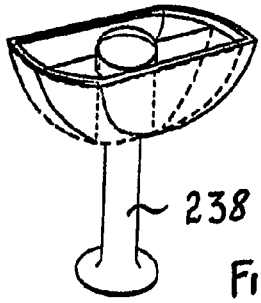
FIG. 44 is a perspective view of the assembled former of FIG. 43.
Figure 45:
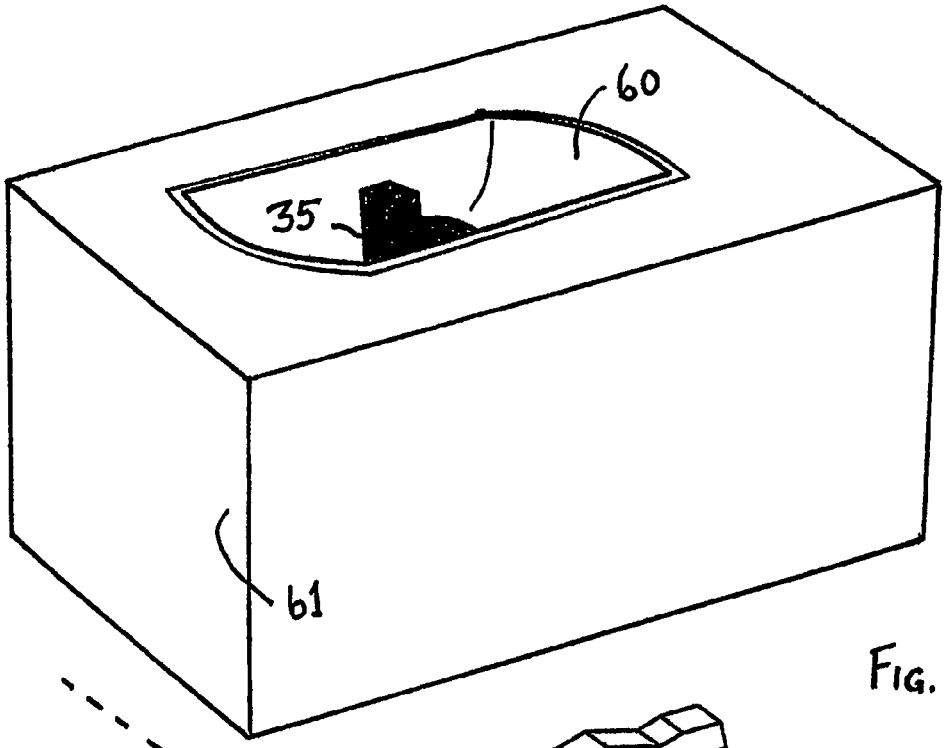
FIG. 45 is a view similar to FIG. 30 but of a former suitable for anchors of generally rectangular cross-section.
Figure 46:
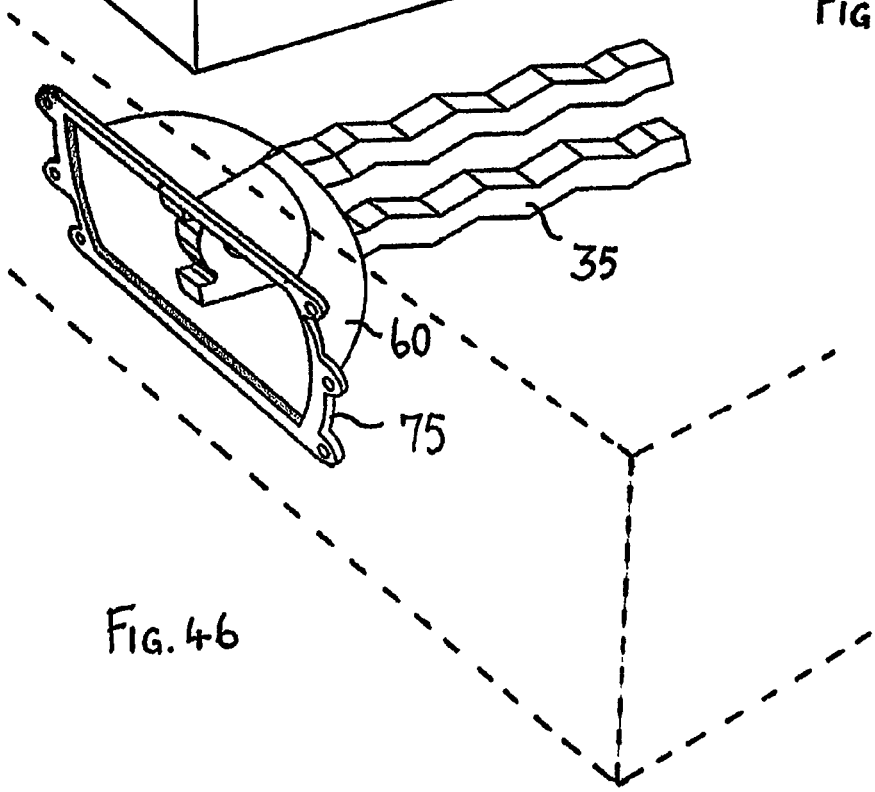
FIG. 46 is the view similar to FIG. 45 but illustrating the former and anchor components within the interior of the concrete.

Turning now to the arrangement as seen in FIGS. 41 and 42, the two-part former 60E is provided with a lid 76 which has an internal sleeve 77 shaped to interlock or engage the head 239 of the anchor 235 by means of a clip (not illustrated) or other such locking element. The sleeve 77 can be made from a resilient material to resiliently engage with the head 239 of the anchor 235. Thus the lid 76 fits tightly over the upper edge of the former 60E. The lid 76 is provided with holes 78 which enable it to be screwed or otherwise secured to the mould or formwork. In a still further arrangement, as illustrated in FIGS. 43 and 44, an interior filler 80 fabricated in two pieces is used to fill the interior of the stay behind former 60 and surround the stem 238 of the anchor 235 immediately below the head 239.

Figure 47:
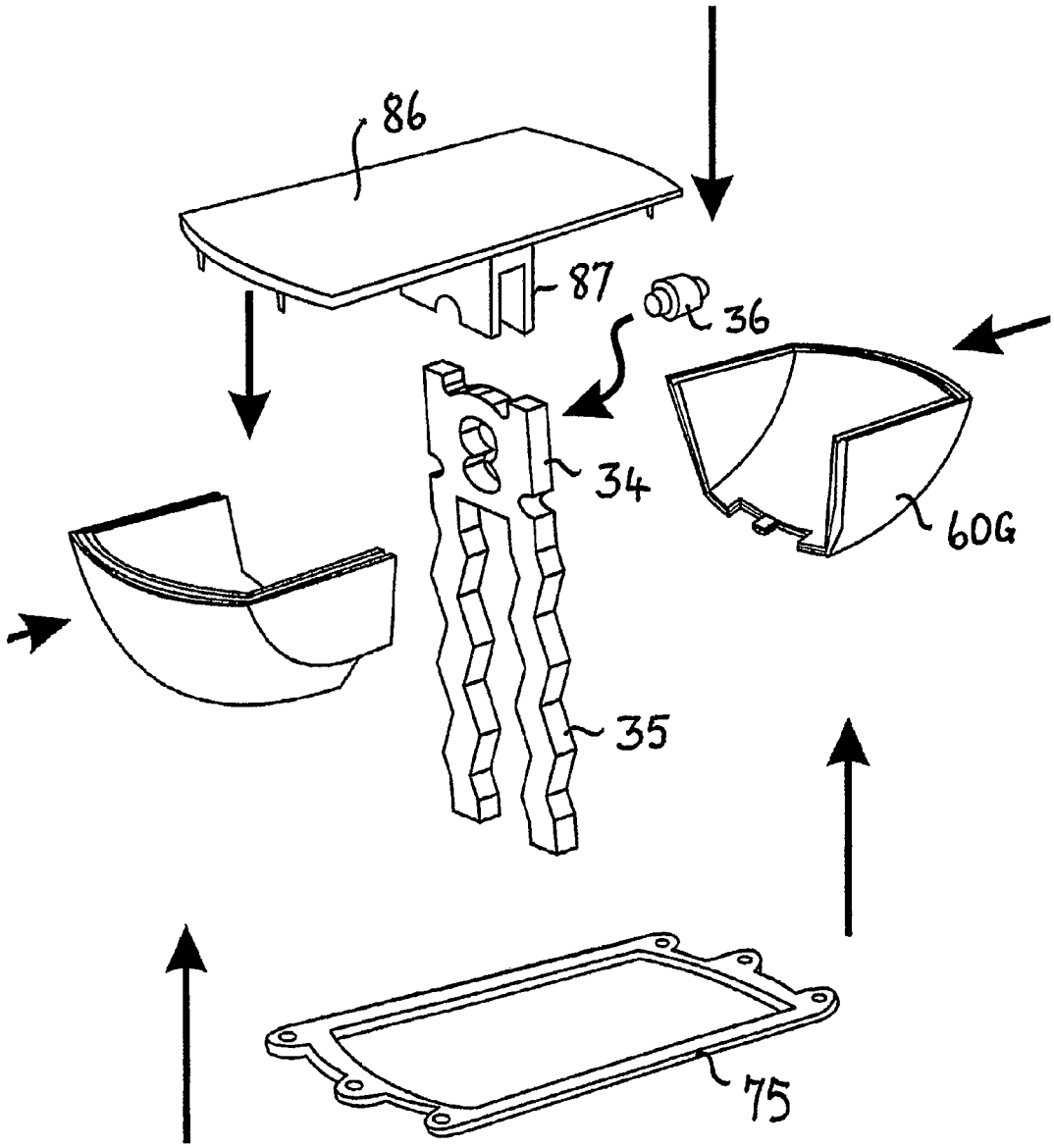
FIG. 47 is an exploded perspective view of the components illustrated in FIG. 46 prior to assembly.
Figure 49:
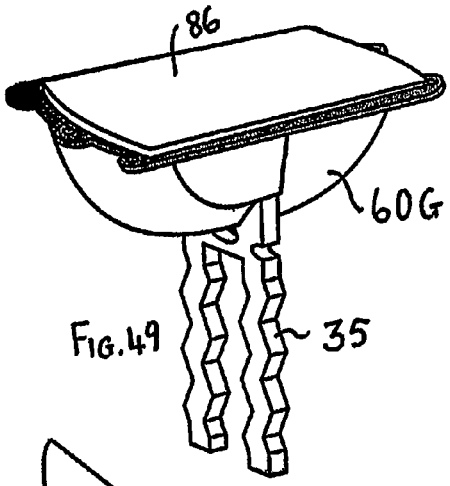
FIG. 49 is a perspective view showing the finalized assembly.
Figure 48:
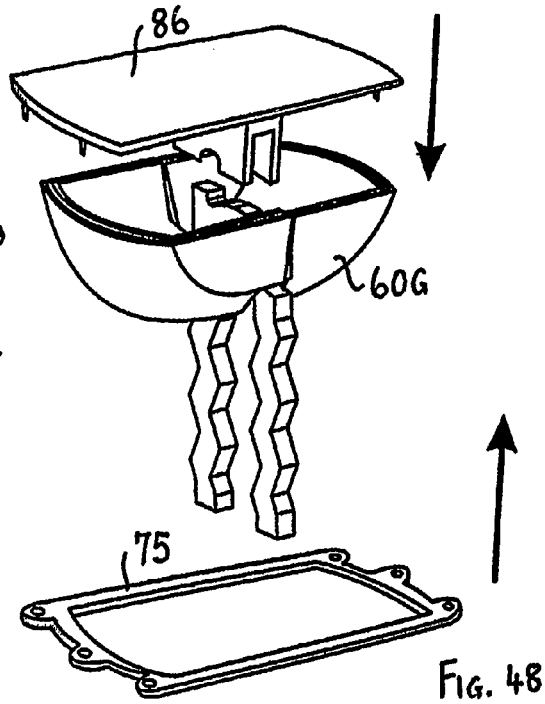
FIG. 48 is a similar exploded perspective view but showing a stage in the assembly.
Figure 50:
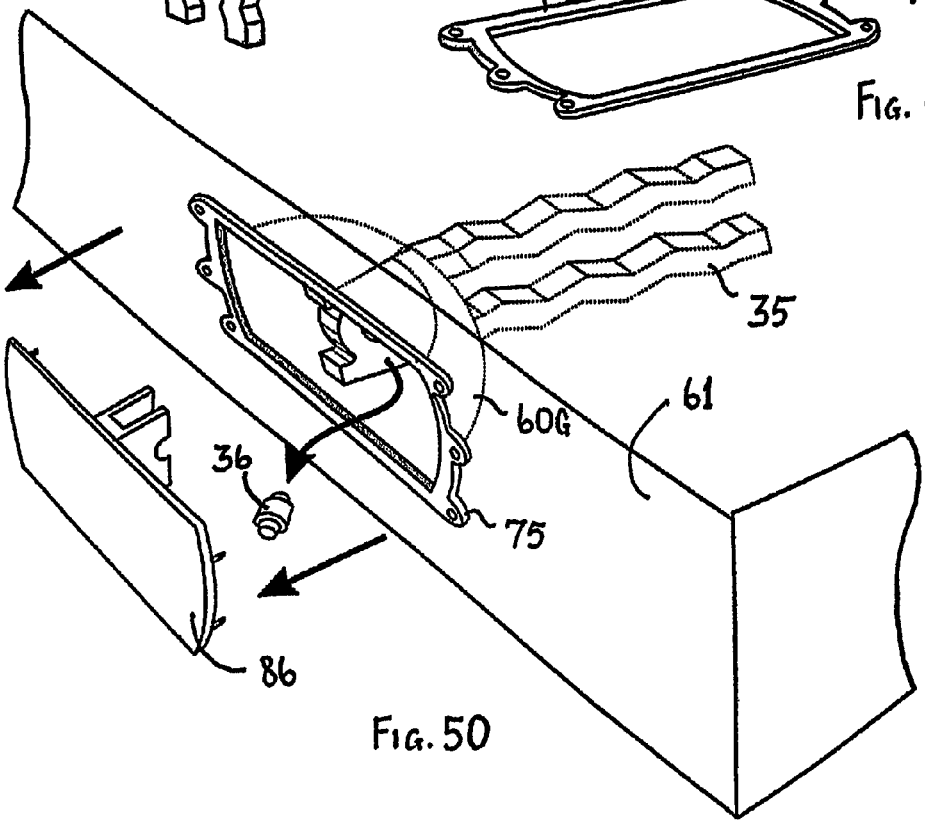
FIG. 50 is a perspective view illustrating the removal of the removable former components.
Figure 51:
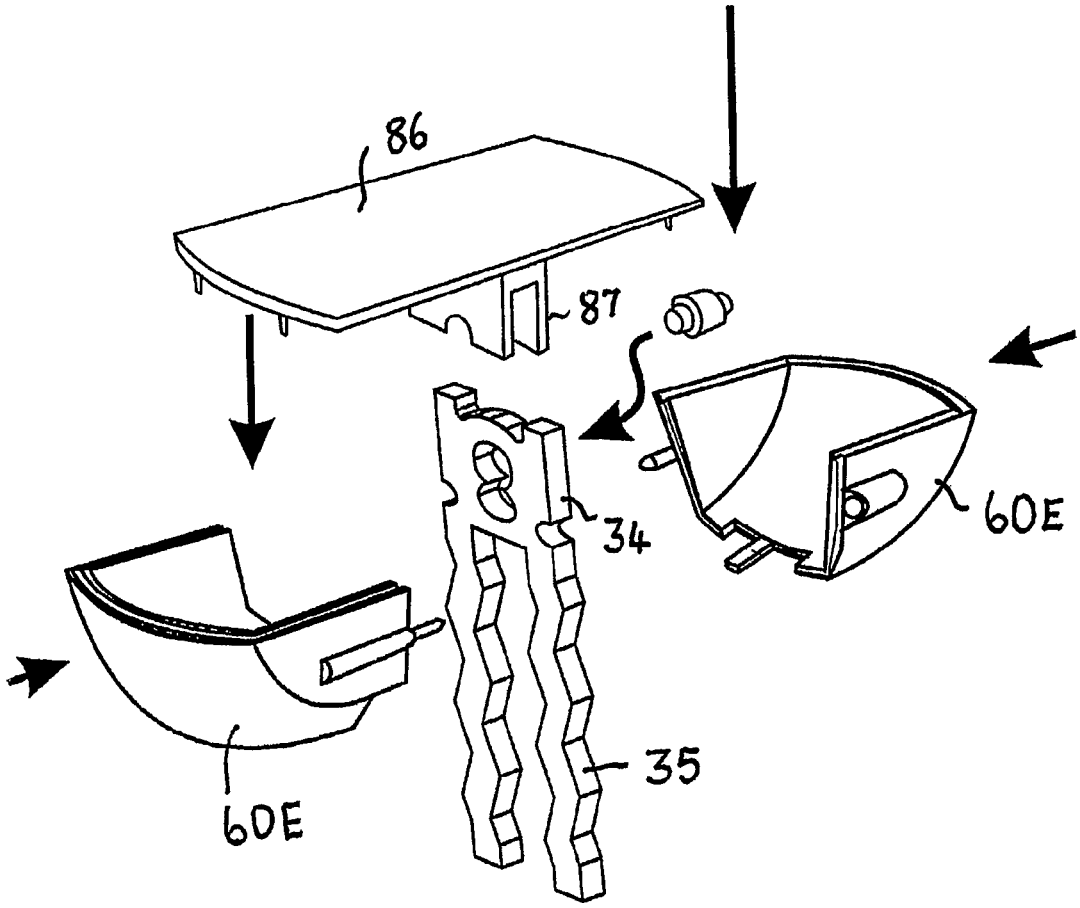
FIG. 51 is a view similar to FIG. 47 and illustrating a former of another embodiment.
Figure 52:
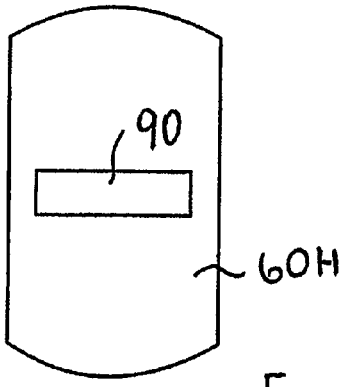
FIG. 52 is an inverted plan in view of a former of a still further embodiment.
Figure 53:
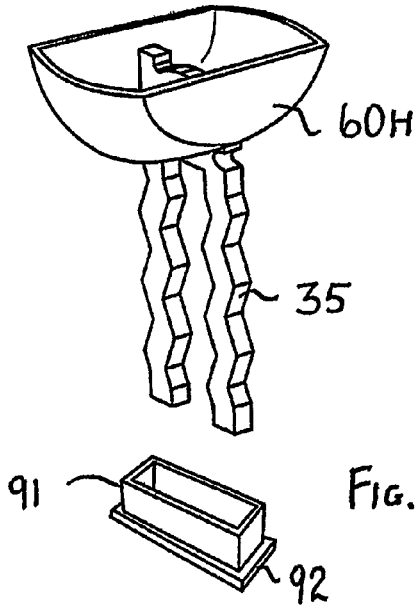
FIG. 53 is an exploded perspective view of the former of FIG. 52 prior to assembly.
Figure 54:
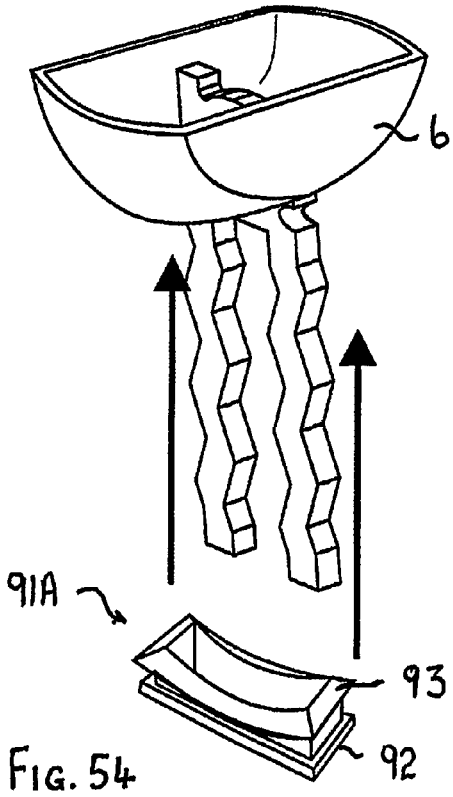
FIG. 54 is a view similar to that of FIG. 53 but of a another embodiment.
Figure 55:
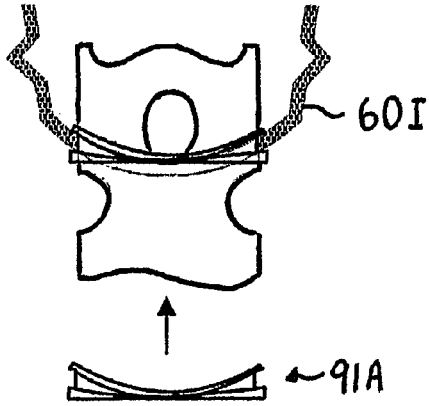
FIG. 55 is a vertical cross sectional view through the former of FIG. 54 and illustrating the into engagement of the State behind former portion and the anchor sleeve.
Figure 56:
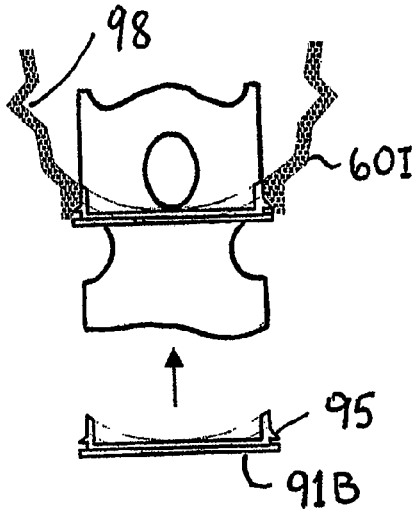
FIG. 56 is a view similar to FIG. 55 but of a former of yet another embodiment.

Turning now to FIGS. 45-51, the concept of a stay behind all embedded former 60 is also applicable to lifting anchors 35 having a generally rectangular configuration. As best seen in FIG. 47, a two-part former 60G is arranged to make with a lifting anchors 35 which is provided with a removable plug 36 to maintain the transverse aperture 23 of concrete. A rectangular surround 75 is provided to lock the two halves of the former 60G together. A lid 86 having a bifurcated protrusion 87 which mates with the attachment head 34 of the anchor 35, seals the upper rim of the former 60G. As seen in FIG. 50, after the concrete slab 61 has been cast, the lid 86 and plug 36 are removed whilst the former 60G and the rectangular surround 75 remain embedded within the concrete slab 61. FIG. 51 illustrates a similar embodiment but utilizing the two-part former 60E.

Turning now to FIGS. 52-56, in a still further embodiment the former 60H is provided with a transverse slot 90 in its base and the anchor 35 is provided with an anchor sleeve 91 which lies over the legs of the anchor and engages with the former 60H. The anchor sleeve 91 has a lower rim or 92 which provides an effective seal for the former 60H. In a further variation illustrated in FIG. 54, the anchor sleeve 91A is provided with a flexible upper rim 93 which mates with the former and thus provides an additional seal. In a still further variation, in FIG. 56, the anchor sleeve 91B is provided with a peripheral ramp 95 which provides for a snap engagement between the anchor sleeve 91B and the former 60I. The sleeve 901A is formed either in one piece or from separable pieces which snap into position around the anchor body 35. The sleeves 91 or 91A are effectively adapted for use with rectangular bodied anchors shown by FIGS. 53-56 but can be generally cylindrical so as to be adapted for round anchors and recess formers such as those shown in FIGS. 32-44.

Figure 57:
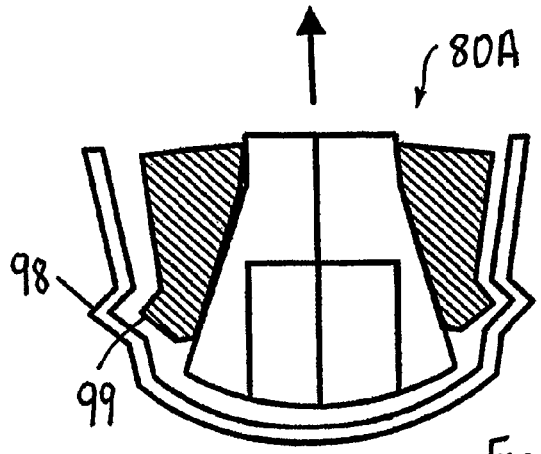
FIG. 57 is a vertical cross sectional view through a stay behind former illustrating a resilient former interior member.
Figure 58:
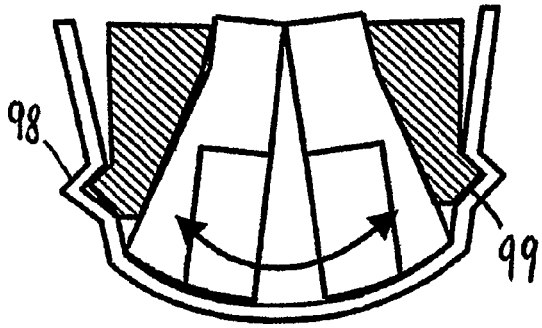
FIG. 58 is a view similar to that of FIG. 57 and illustrating the snap engagement.
Figure 59:
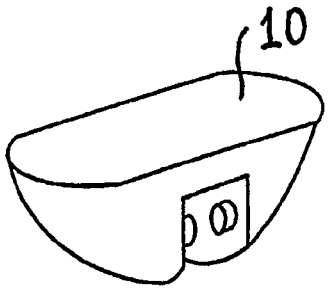
FIG. 59 is an exploded perspective view similar to that of FIG. 1.
Figure 59:
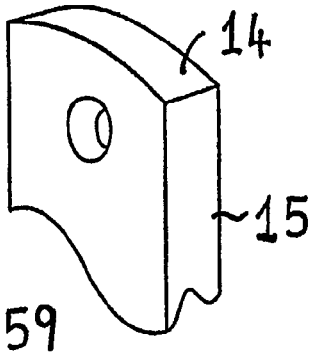
Figure 60:
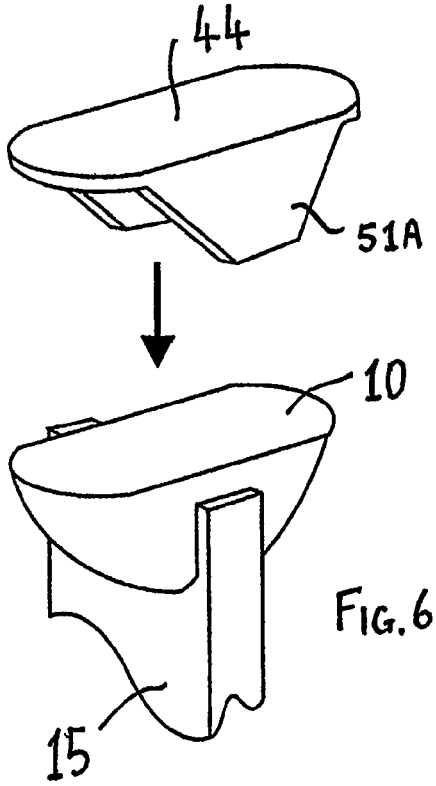
FIG. 60 is an exploded perspective view illustrating how the prior art arrangement of FIG. 59 can be modified to provide a gap between the side edges of the anchor and the concrete by means of a lid with side flaps.

In FIGS. 55-58, the former 60I is provided with a pair of indentations 98 in its curved surface which, as seen in FIGS. 57-58, allows a resilient interior member 80A having a corresponding pair of mating ridges 99 to releasably snap engage with the former 601. The interior member 80A enables the attachment end 34 of the anchor 35 to be grasped and at the same time enables the former 60I to be held, thereby providing a mechanical lock between the former 60I and the attachment head 34.

Figure 62:
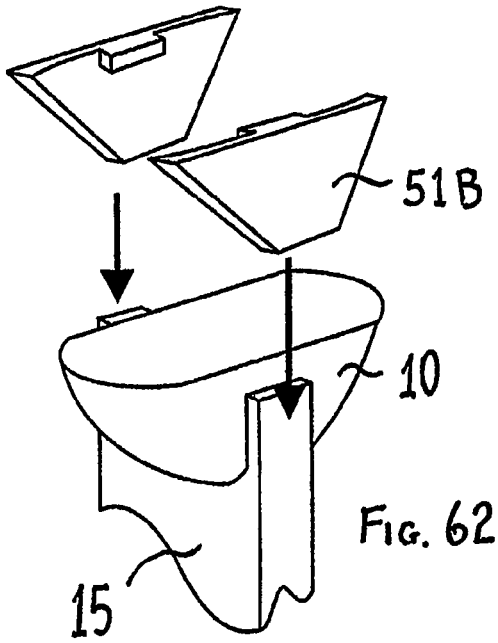
FIG. 62 is an exploded perspective view similar to FIG. 60 but of a still further embodiment.
Figure 61:
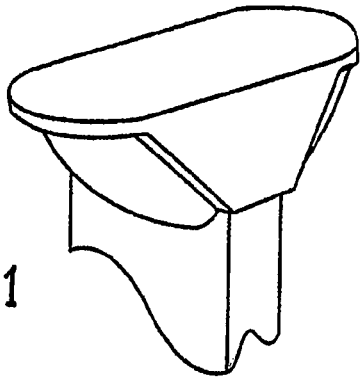
FIG. 61 is a perspective view showing the assembled arrangement of FIG. 60.

As seen in FIGS. 59-62, the conventional recess former 10 when it engages with the conventional anchor 15, results in the side edges of the anchor 15 being embedded in the concrete. However, the provision of a cap 44 having side flaps 51A which slides over the conventional recess former 10, prevents the concrete to be cast from engaging the side edges of the anchor 15 which thus remained free from the concrete. Once the concrete has taken its initial set, the cap 44 and recess former 10 can be removed, thereby creating the gap 53 of FIG. 17. An alternative arrangement is illustrated in FIG. 62 where individual side flaps 51B are provided.

The foregoing describes only some embodiments of the present invention and modifications, obvious to those skilled in the concrete arts, can be made thereto without departing from the scope of the present invention.

The term "comprising" (and its grammatical variations) as used herein is used in the inclusive sense of "including" or "having" and not in the exclusive sense of "consisting only of"

The invention claimed is:

1. A recess former assembly for a concrete panel cast in formwork, said panel having an anchor, said anchor having a head, a pair of major opposed surfaces, a pair of minor opposed surfaces, and at least one through aperture in the anchor head extending between said major opposed surfaces, the recess former assembly comprising:

a resilient former having an opening which is shaped to receive the head of the anchor, and a body which defines the shape of the recess; and a unitary plug separate from said former and not connected with said formwork, said plug having at least a portion with a shape which matches said aperture to permit said plug to be inserted into the anchor head aperture prior to casting said concrete panel to completely fill the aperture and thereby prevent the ingress of cementitious material into said aperture during casting, and said plug being removable from said anchor head.

2. The recess former assembly as claimed in claim 1, further comprising retention means formed in said former to retain said plug inserted in said aperture during said casting.

3. The recess former assembly as claimed in claim 2, wherein said plug is substantially cylindrical, and said retention means comprises a pair of opposed recesses in said former.

4. The recess former assembly as claimed in claim 3, wherein said plug has a cylindrical central portion located between a pair of frusto-conical end portions.

5. The recess former assembly as claimed in claim 2, wherein said retention means comprises a generally U-shaped locking rod having two arms each of which engages a corresponding end of said plug.

6. The recess former assembly as claimed in claim 1, and having side walls which are substantially parallel to each other and to said minor opposed surfaces of said anchor head, and to a longitudinal axis of said anchor head aperture, said side walls creating a gap between said anchor head and the cast concrete adjacent to said minor opposed surfaces of said anchor head.

7. The recess former assembly as claimed in claim 6, wherein said side walls have a characteristic selected from a group consisting of being integrally formed with the former, being fabricated separately from the former, and being incorporated in a cap for the former.

8. The recess former assembly as claimed in claim 1, wherein said former has a characteristic selected from a group consisting of being integrally formed, and being formed in at least two pieces.

9. The recess former assembly as claimed in claim 8, that is formed in at least two pieces which are pivotally interconnected.

10. The recess former assembly as claimed in claim 1, wherein said former has an exterior anchoring protrusion to engage with said cast concrete, whereby said former remains together with said concrete after casting.

11. The recess former assembly as claimed in claim 10, further comprising at least one reinforcing support to retain a corresponding reinforcing rod in relation to said former and anchor prior to, and during, casting of said concrete.

12. The recess former assembly as claimed in claim 1, wherein said plug comprises an attachment to said anchor head and is not connected with said formwork.

13. A method of casting a concrete member having a recess, said method comprising the step of utilizing the recess former assembly as claimed in claim 1 to form said recess during casting of said member.

14. A cast concrete member including a recess and cast in accordance with the method claimed in claim 12.

* * * * *